US011063387B2

(12) United States Patent
Aoki et al.

(10) Patent No.: US 11,063,387 B2
(45) Date of Patent: Jul. 13, 2021

(54) CONNECTOR HAVING A SEALING MEMBER INTERPOSED BETWEEN THE CONNECTOR SUPPORT MEMBER AND HOUSING

(71) Applicant: Yazaki Corporation, Tokyo (JP)

(72) Inventors: Eiji Aoki, Shizuoka (JP); Kazuhide Takahashi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/937,795

(22) Filed: Jul. 24, 2020

(65) Prior Publication Data

US 2021/0036458 A1 Feb. 4, 2021

(30) Foreign Application Priority Data

Jul. 29, 2019 (JP) ..... JP2019-138463

(51) Int. Cl.
*H01R 13/52* (2006.01)

(52) U.S. Cl.
CPC ..... *H01R 13/5205* (2013.01); *H01R 13/5216* (2013.01)

(58) Field of Classification Search
CPC . H01R 13/5205; H01R 13/5216; H01R 13/52
See application file for complete search history.

(56) References Cited

U.S. PATENT DOCUMENTS 10,411,385 B2 * 9/2019 Higashitani ..... H01R 13/2414
10,797,430 B2 * 10/2020 Shinoda ..... H01R 13/405
10,819,061 B2 * 10/2020 Xia ..... H01R 13/405
2011/0176941 A1 * 7/2011 Albers ..... E21B 17/023 417/410.1
2019/0379154 A1 12/2019 Nishijima
2021/0036457 A1 * 2/2021 Aoki ..... H01R 13/502
2021/0044052 A1 * 2/2021 Takahashi ..... H01R 13/5202
2021/0044053 A1 * 2/2021 Aoki ..... H01R 13/502
2021/0091507 A1 * 3/2021 Aoki ..... H01R 13/521

FOREIGN PATENT DOCUMENTS

JP 2014-093248 A 5/2014
JP 2014-135131 A 7/2014
JP 2018-116896 A 7/2018
JP 2018-125078 A 8/2018

* cited by examiner

*Primary Examiner* — Vanessa Girardi
(74) *Attorney, Agent, or Firm* — Sughrue Mion, PLLC

(57) ABSTRACT

A connector includes an insulating housing that is fixed to a casing of a first device at a communication part through which an opening of the casing of the first device and an opening of a casing of a second device communicate with each other and includes first through holes, conductors that are inserted into the respective first through holes to electrically connect the first device and the second device, an insulating sealing member that includes tubular sealing parts that seal between the conductors and the housing, and a connecting part that connects the sealing parts, and an insulating support member that includes second through holes into which the conductors are inserted, is attached to the housing from a side of the second device, and interposes the sealing member between the support member and the housing to support the sealing parts.

11 Claims, 23 Drawing Sheets

CONNECTOR HAVING A SEALING MEMBER INTERPOSED BETWEEN THE CONNECTOR SUPPORT MEMBER AND HOUSING

CROSS-REFERENCE TO RELATED APPLICATION(S)

The present application claims priority to and incorporates by reference the entire contents of Japanese Patent Application No. 2019-138463 filed in Japan on Jul. 29, 2019.

BACKGROUND OF THE INVENTION

1. Field of the Invention

The present invention relates to a connector.

2. Description of the Related Art

In the related art, a connector having a sealing member is known. Japanese Patent Application Laid-open No. 2018-116896 discloses a technology of a connector including a main housing retaining a main terminal for relaying a main circuit, an electric wire with a connector including an electric wire for relaying a sub-circuit and a sub-connector connected to a terminal of the electric wire, and an electric wire retention part connecting with the main housing and retaining the electric wire.

In the connector of Japanese Patent Application Laid-open No. 2018-116896, the electric wire and the electric wire retention part are sealed by a potting material or a rubber stopper.

It is desired to simplify the work of manufacturing a connector having a plurality of conductors and a sealing member. For example, when an O ring and a stopper are individually attached to each of the conductors, since the amount of work required for the attachment increases, work efficiency may decrease.

SUMMARY OF THE INVENTION

An object of the present invention is to provide a connector capable of simplifying manufacturing work.

In order to achieve the above mentioned object, a connector according to one aspect of the present invention includes an insulating housing that is fixed to a casing of a first device at a communication part through which an opening of the casing of the first device and an opening of a casing of a second device communicate with each other, and includes a plurality of first through holes that allow an internal space of the first device and an internal space of the second device to communicate with each other; a plurality of conductors configured to be inserted into the respective first through holes to electrically connect the first device and the second device; an insulating sealing member that includes a plurality of annular sealing parts that seal between the conductors and the housing, and a connecting part that connects the sealing parts; and an insulating support member that includes a plurality of second through holes into which the conductors are inserted, is configured to be attached to the housing from a side of the second device so as to interpose the sealing member between the support member and the housing and support the sealing parts.

According to another aspect of the present invention, in the connector, it is preferable that the support member includes an insulating wall that partitions the conductors adjacent to each other.

According to still another aspect of the present invention, in the connector, it is preferable that the connector further includes a first insertion structure disposed between the conductors adjacent to each other, wherein the first insertion structure includes a first concave part provided in one of the housing and the sealing member, and a first insertion wall provided in the other one of the housing and the sealing member, the first concave part includes a pair of first facing surfaces facing each other in an arrangement direction in which the conductors are arranged and a first connection surface connecting the pair of first facing surfaces, and the first insertion wall is inserted between the pair of first facing surfaces.

According to still another aspect of the present invention, in the connector, it is preferable that the connector further includes a second insertion structure disposed between the conductors adjacent to each other, wherein the second insertion structure includes a second concave part provided in one of the sealing member and the support member, and a second insertion wall provided in the other one of the sealing member and the support member, the second concave part includes a pair of second facing surfaces facing each other in an arrangement direction in which the conductors are arranged and a second connection surface connecting the pair of second facing surfaces, and the second insertion wall is inserted between the pair of second facing surfaces.

According to still another aspect of the present invention, in the connector, it is preferable that a material of the housing and a material of the sealing member have resistance to a first liquid stored in the internal space of the first device, and a material of the support member has resistance to a second liquid different from the first liquid.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, a connector according to an embodiment of the present invention will be described in detail with reference to the drawings. Note that the invention is not limited to the embodiment. Furthermore, the components in the following embodiments include those that can be easily arrived at by a person skilled in the art or those that are substantially the same.

EMBODIMENT

Figure 1:
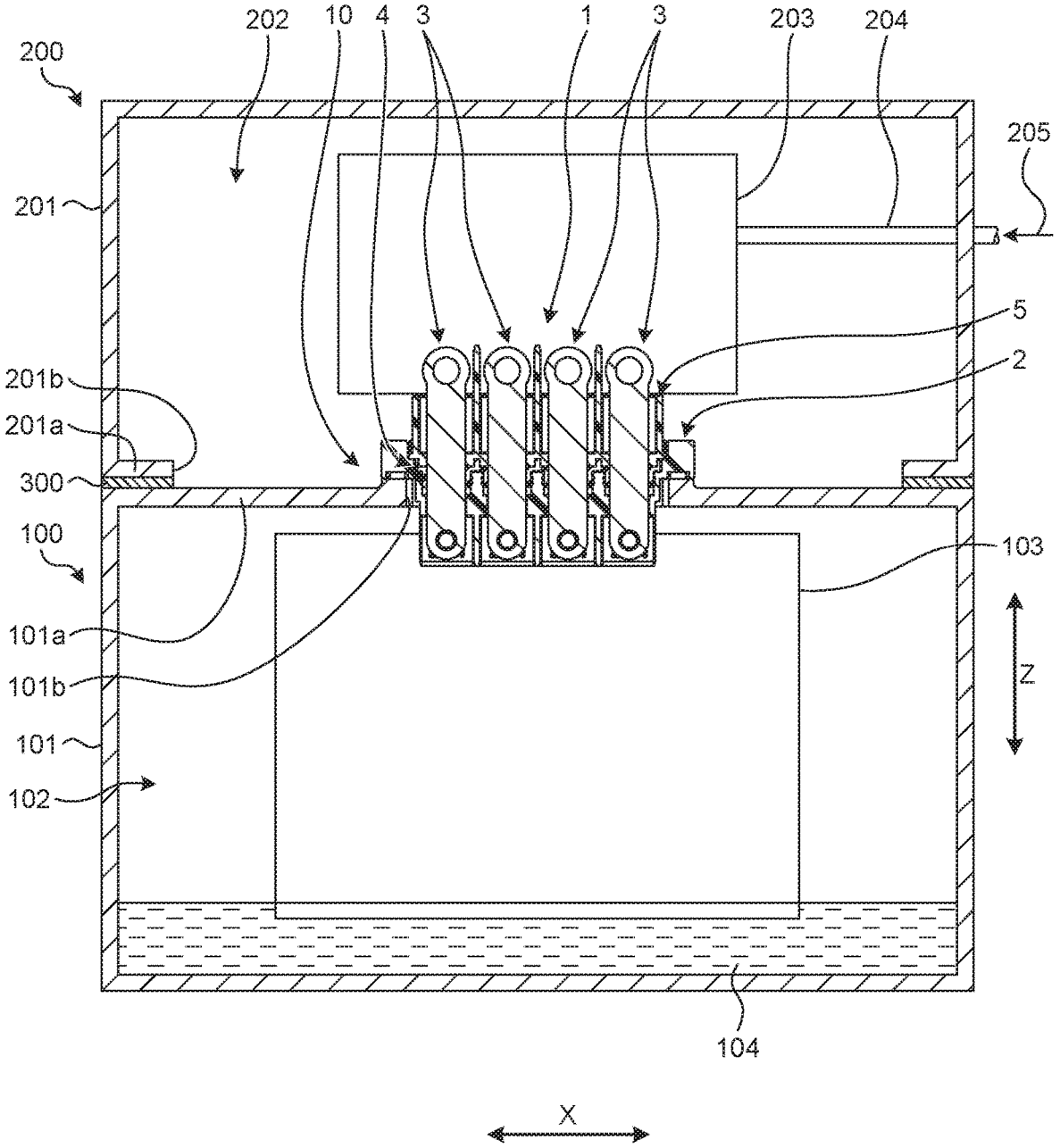
FIG. 1 is a sectional view of a connector, a first device, and a second device according to an embodiment.
Figure 4:
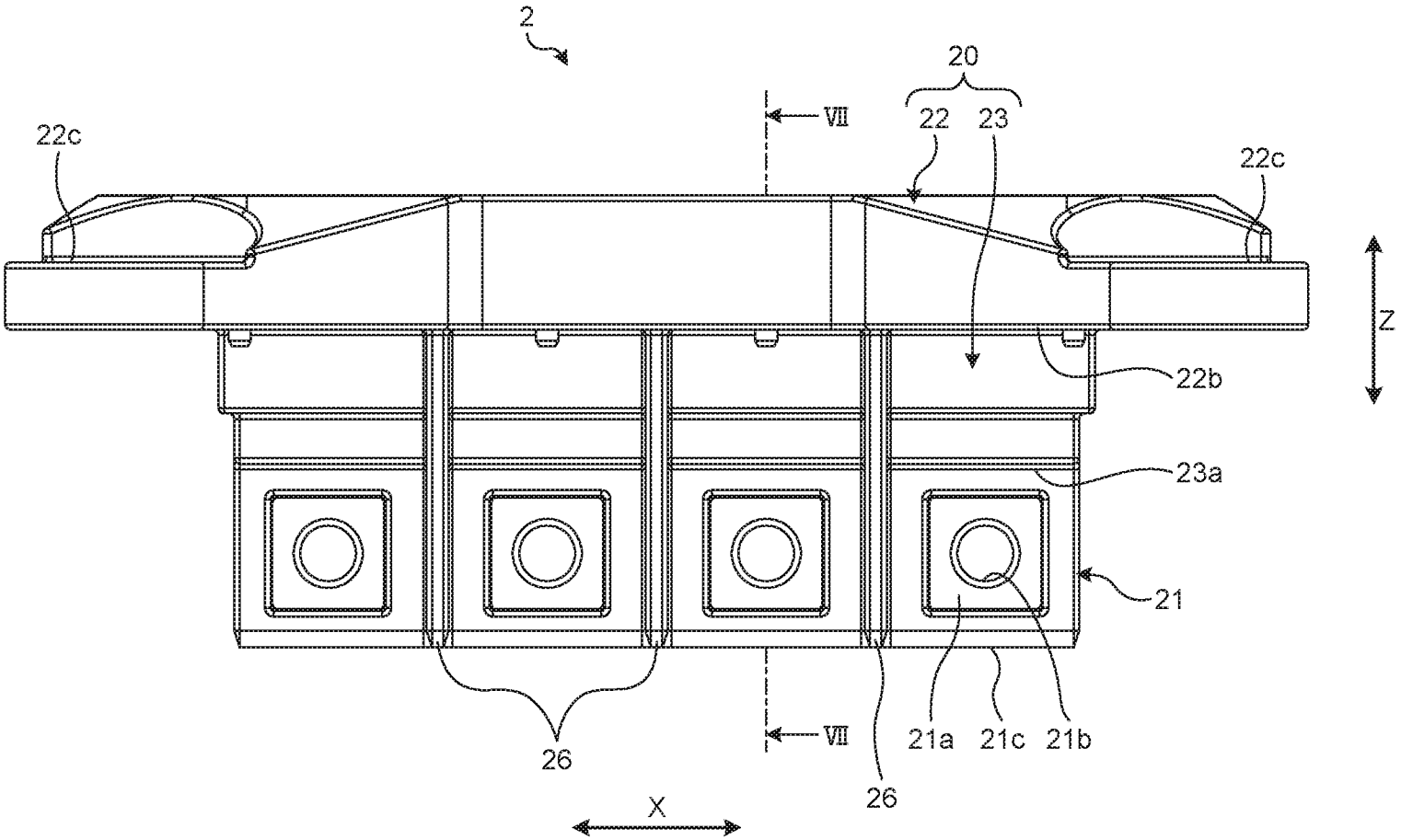
FIG. 4 is a front view of the housing according to the embodiment.
Figure 5:
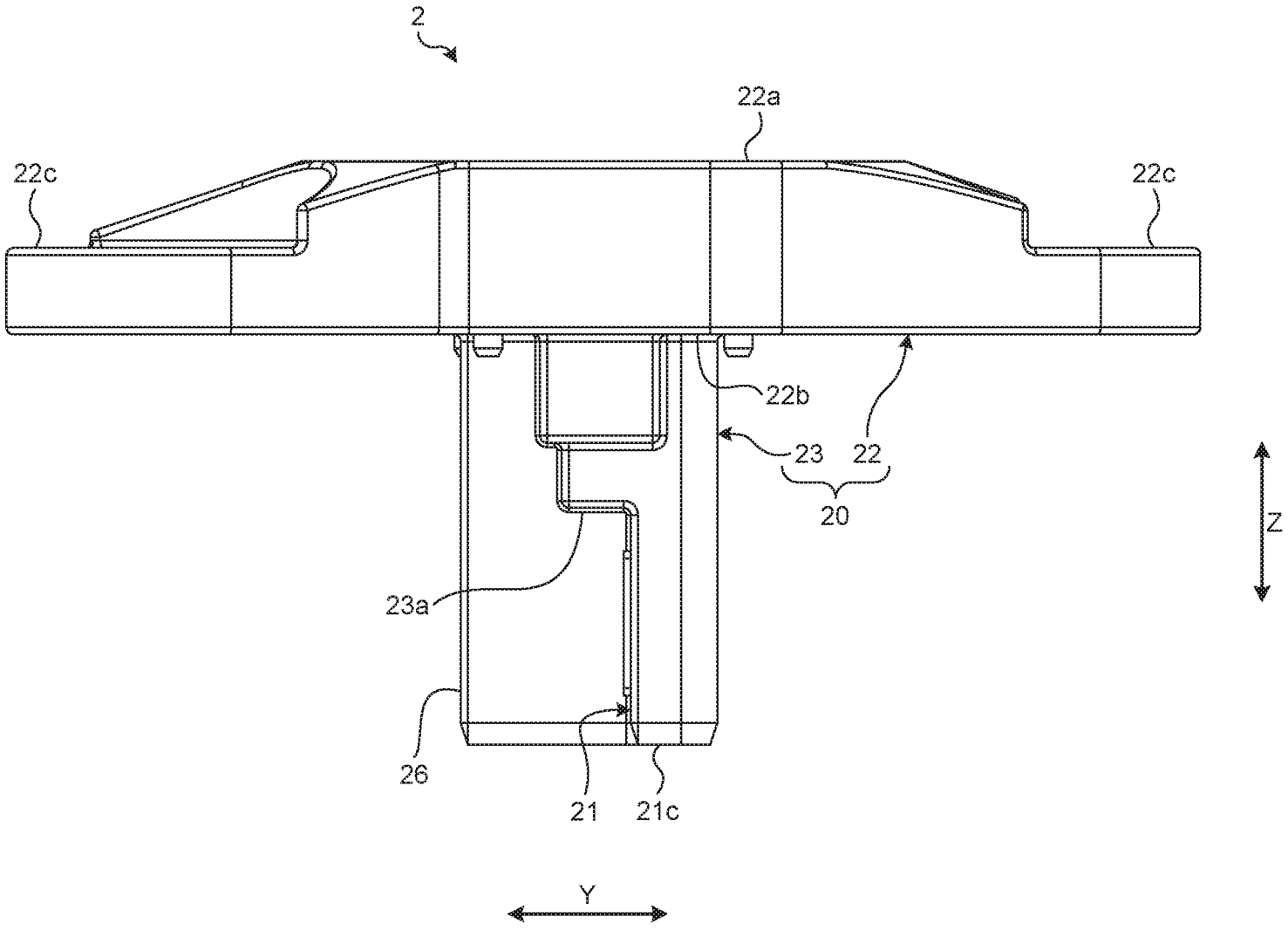
FIG. 5 is a side view of the housing according to the embodiment.
Figure 7:
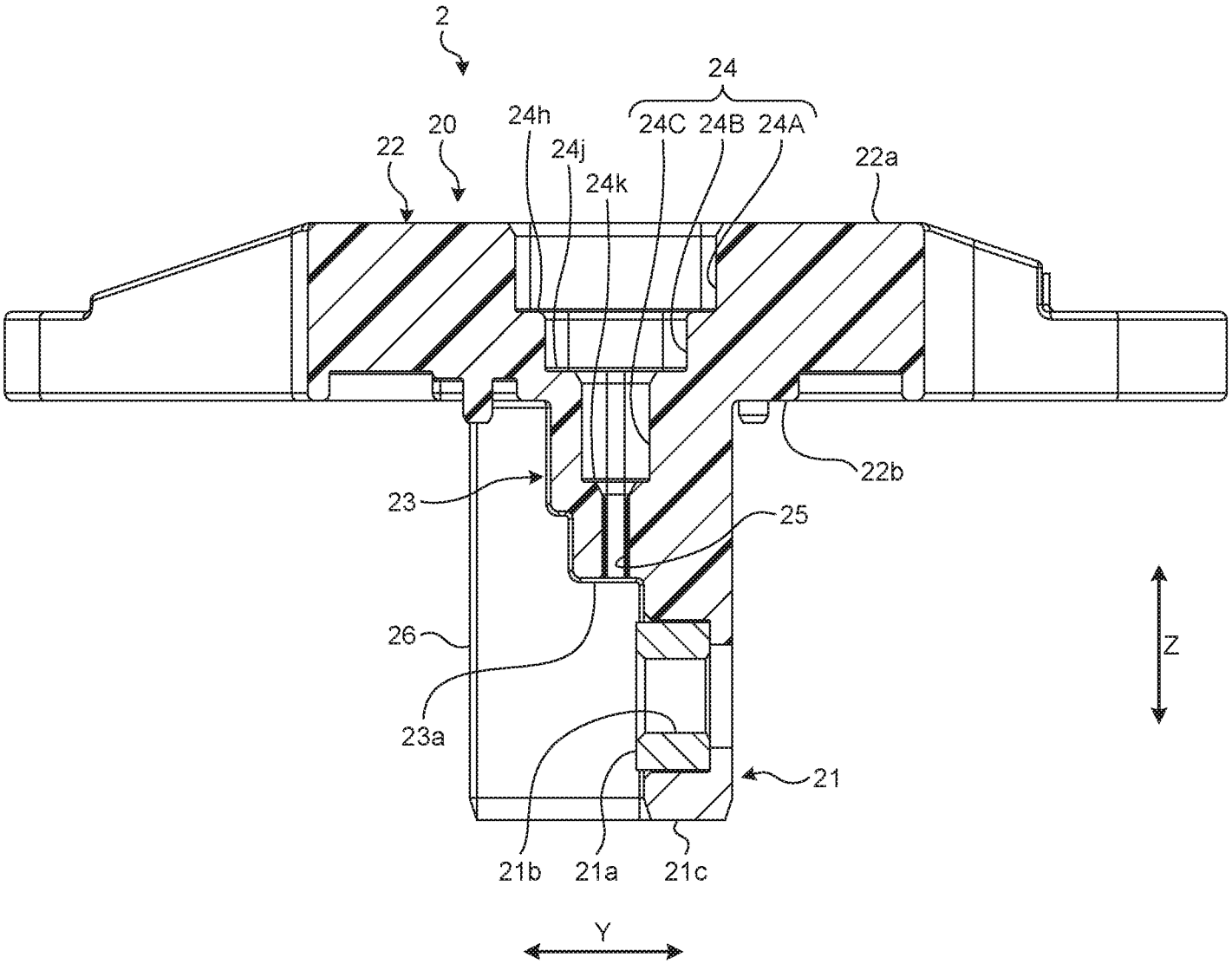
FIG. 7 is another sectional view of the housing according to the embodiment.
Figure 8:
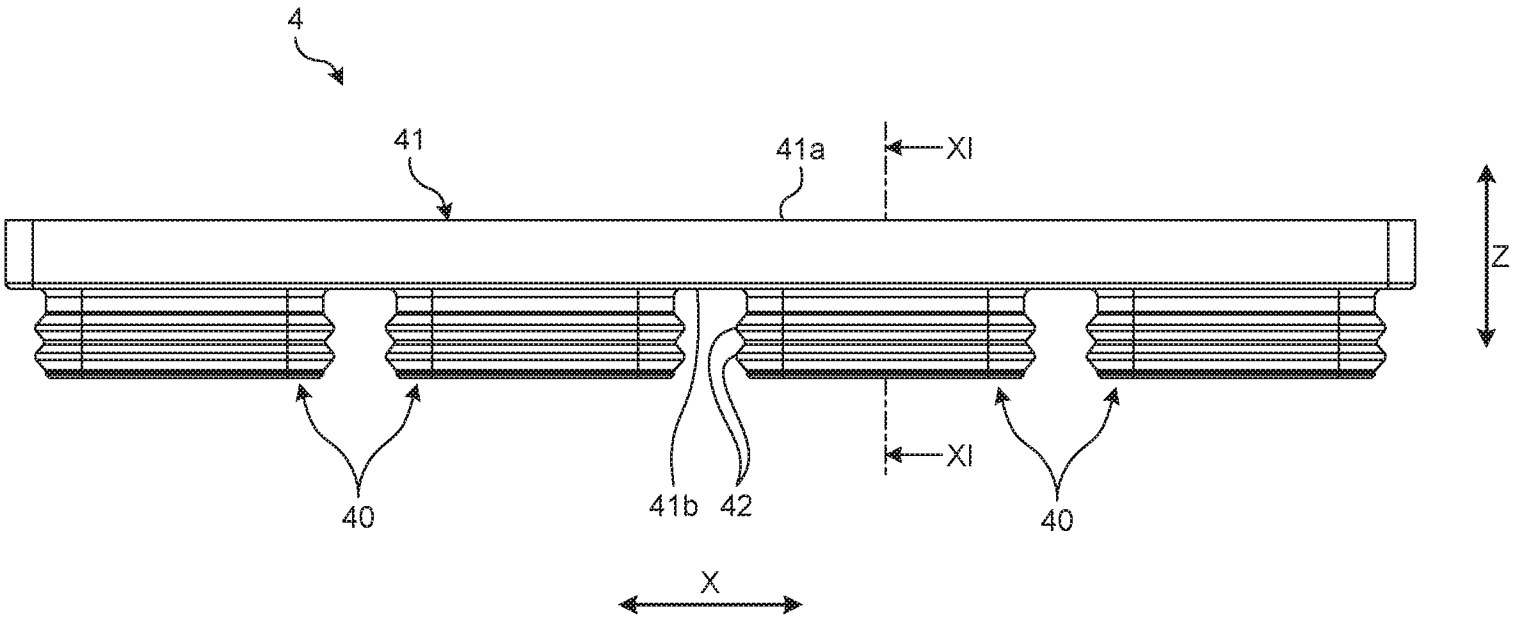
FIG. 8 is a front view of a sealing member according to the embodiment.
Figure 9:
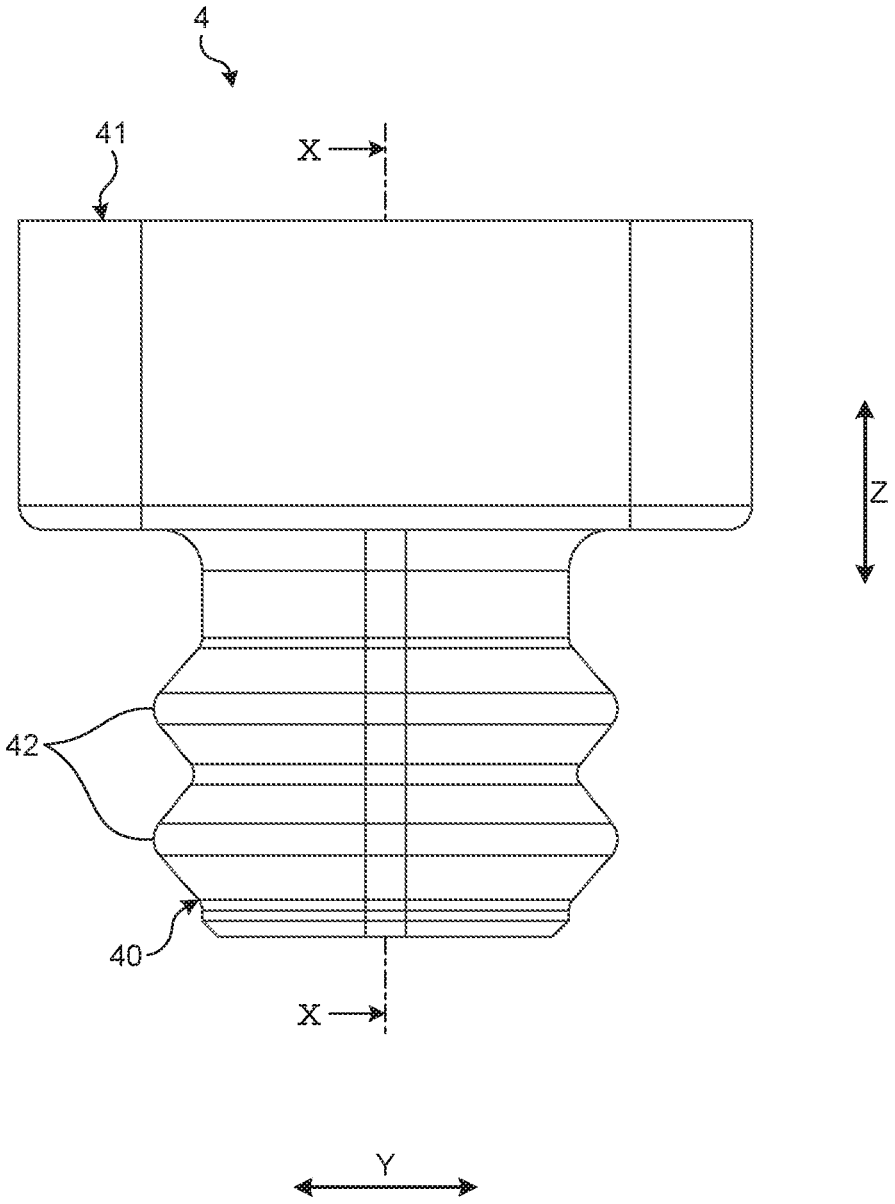
FIG. 9 is a side view of the sealing member according to the embodiment.
Figure 10:
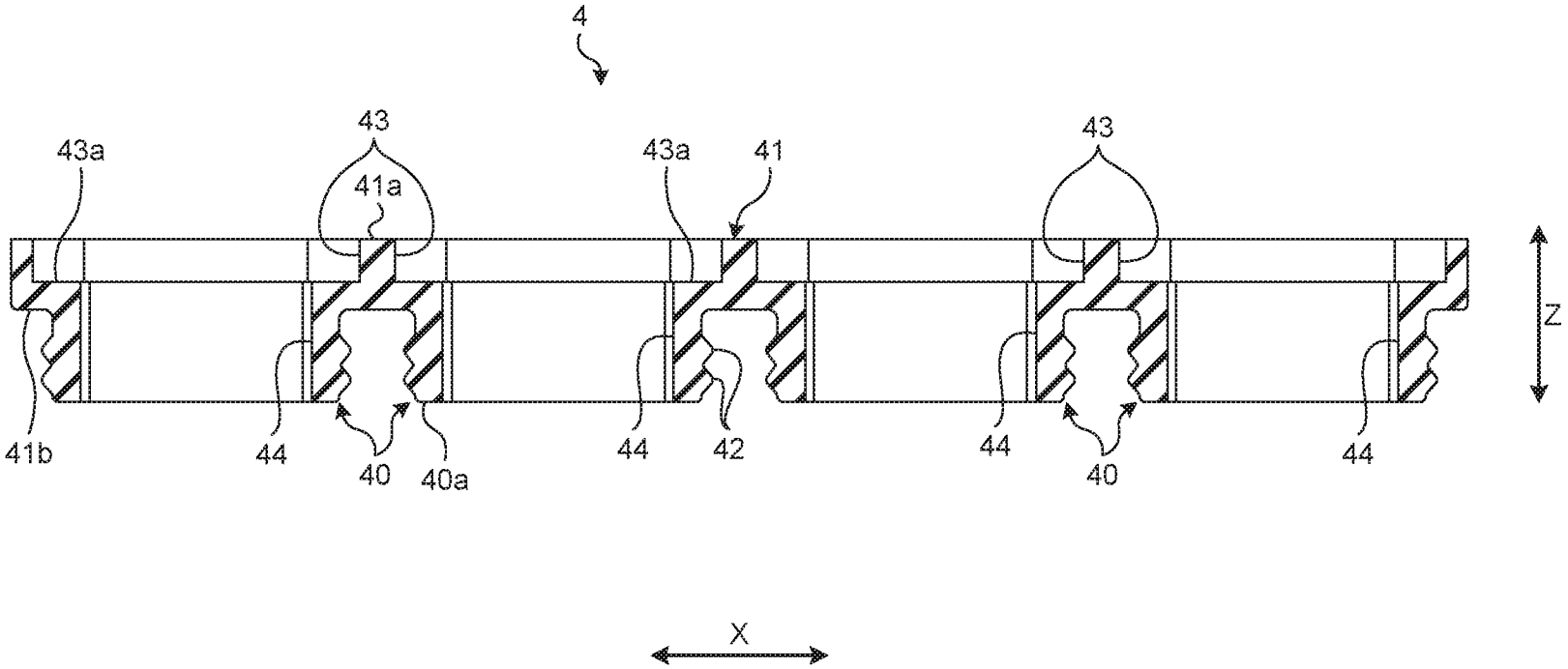
FIG. 10 is a sectional view of the sealing member according to the embodiment.
Figure 11:
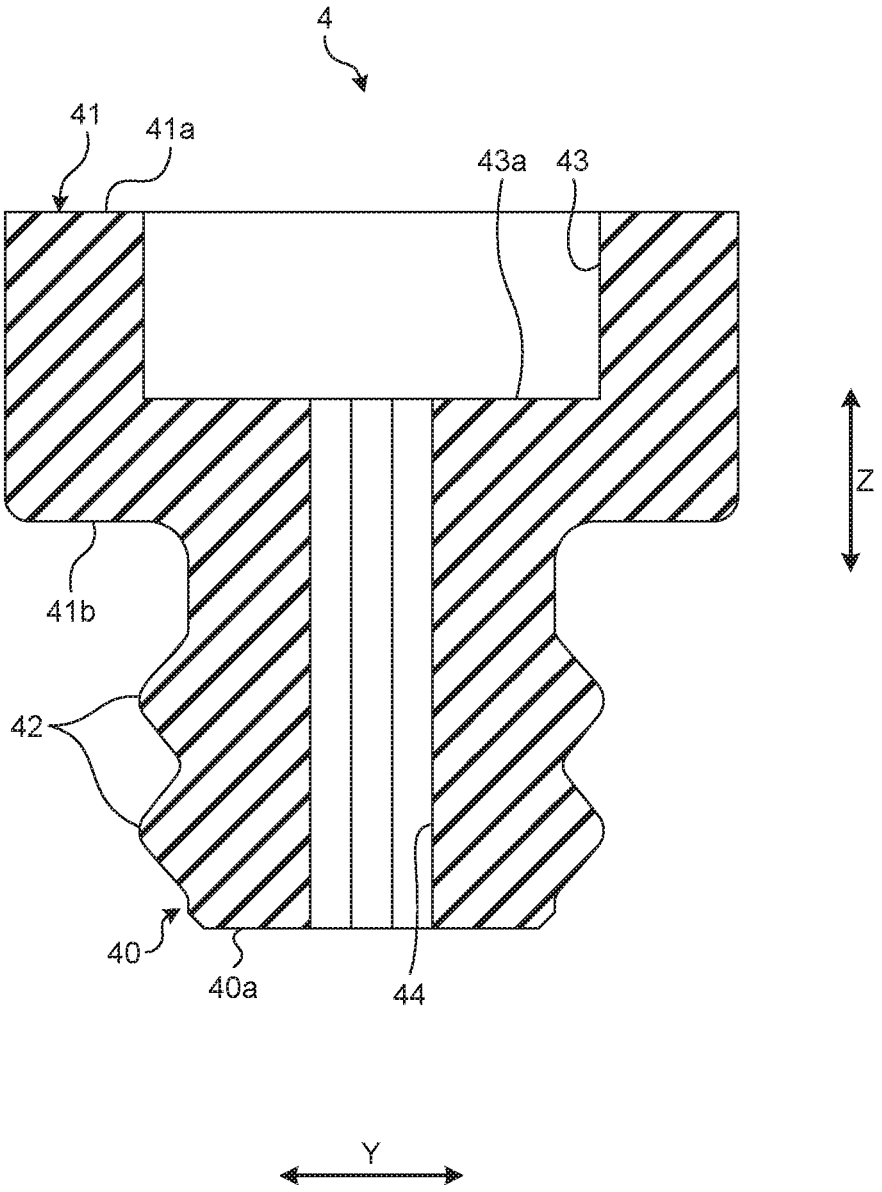
FIG. 11 is another sectional view of the sealing member according to the embodiment.

With reference to FIG. 1 to FIG. 23, the embodiment will be described. The present embodiment relates to a connector. FIG. 1 is a sectional view of a connector, a first device, and a second device according to an embodiment, FIG. 2 is an exploded perspective view of the connector according to the embodiment, FIG. 3 is a plan view of a housing according to the embodiment, FIG. 4 is a front view of the housing according to the embodiment, FIG. 5 is a side view of the housing according to the embodiment, FIG. 6 is a sectional view of the housing according to the embodiment, FIG. 7 is another sectional view of the housing according to the embodiment, FIG. 8 is a front view of a sealing member according to the embodiment, FIG. 9 is a side view of the sealing member according to the embodiment, FIG. 10 is a sectional view of the sealing member according to the embodiment, and FIG. 11 is another sectional view of the sealing member according to the embodiment.

Figure 12:
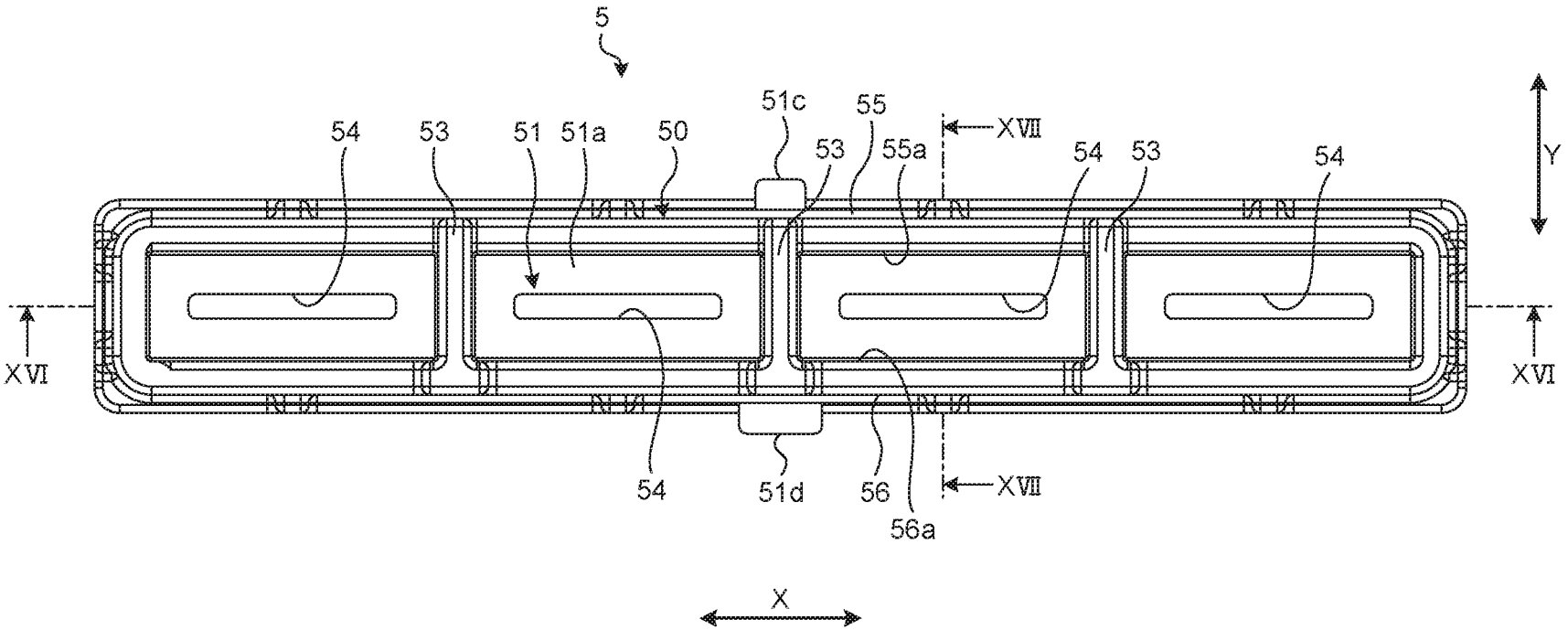
FIG. 12 is a plan view of a support member according to the embodiment.
Figure 13:
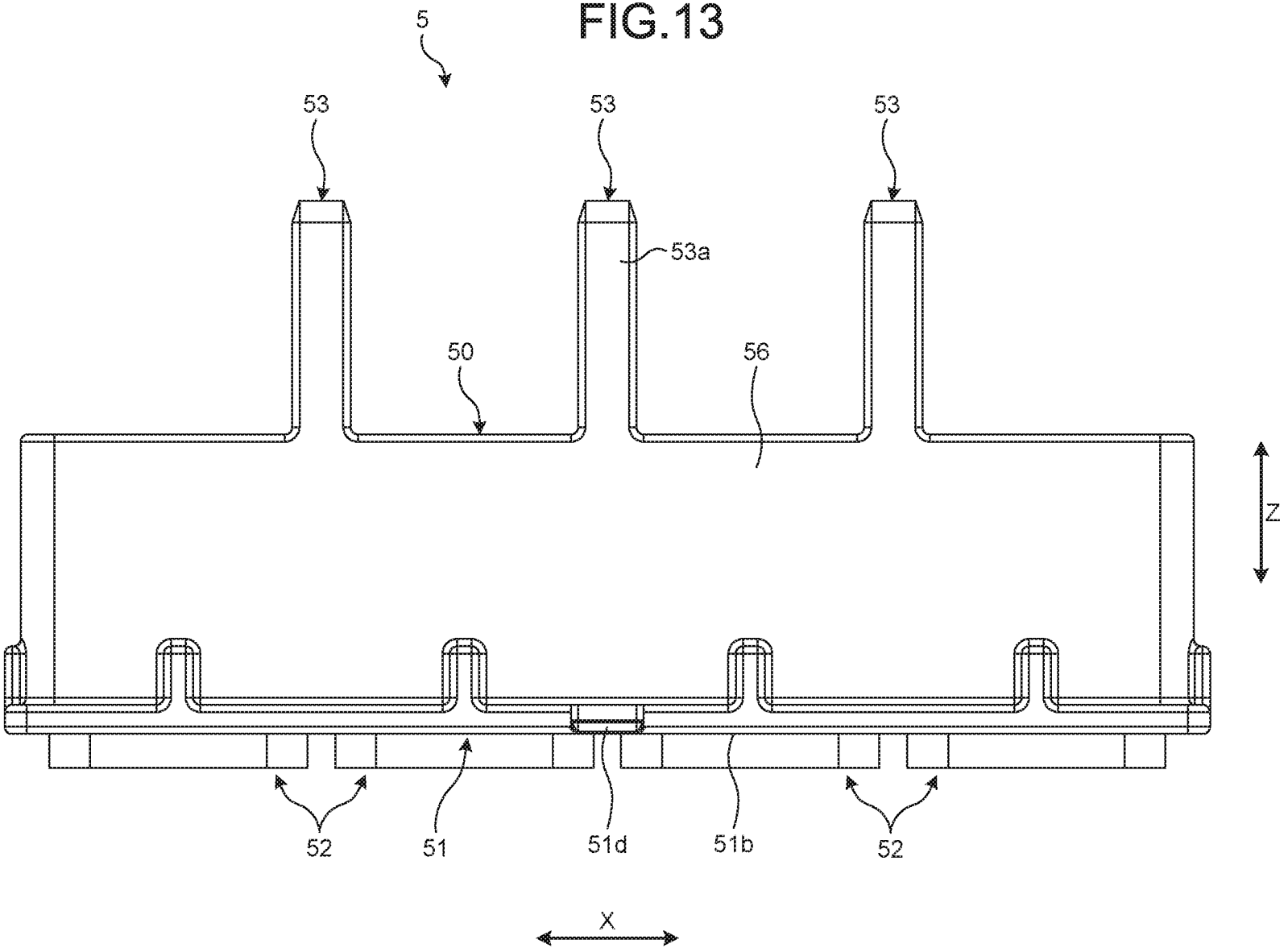
FIG. 13 is a front view of the support member according to the embodiment.
Figure 14:
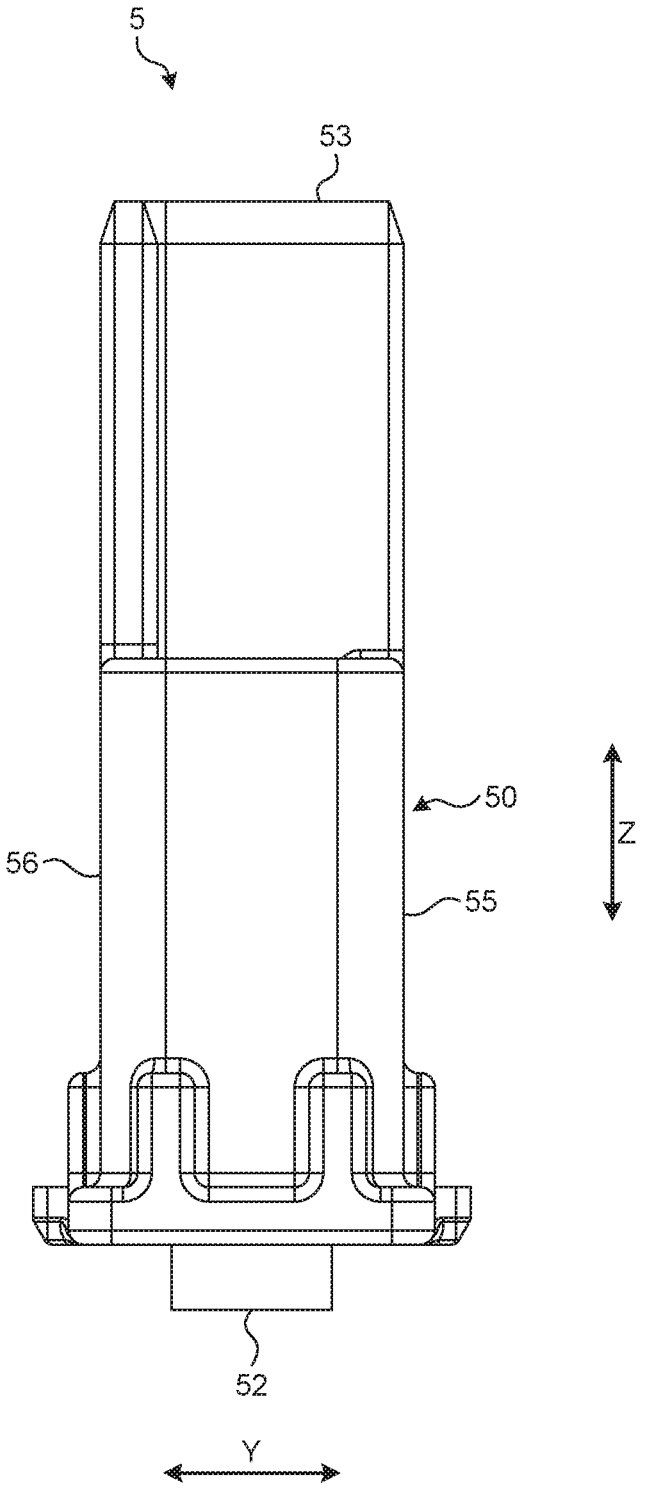
FIG. 14 is a side view of the support member according to the embodiment.
Figure 15:
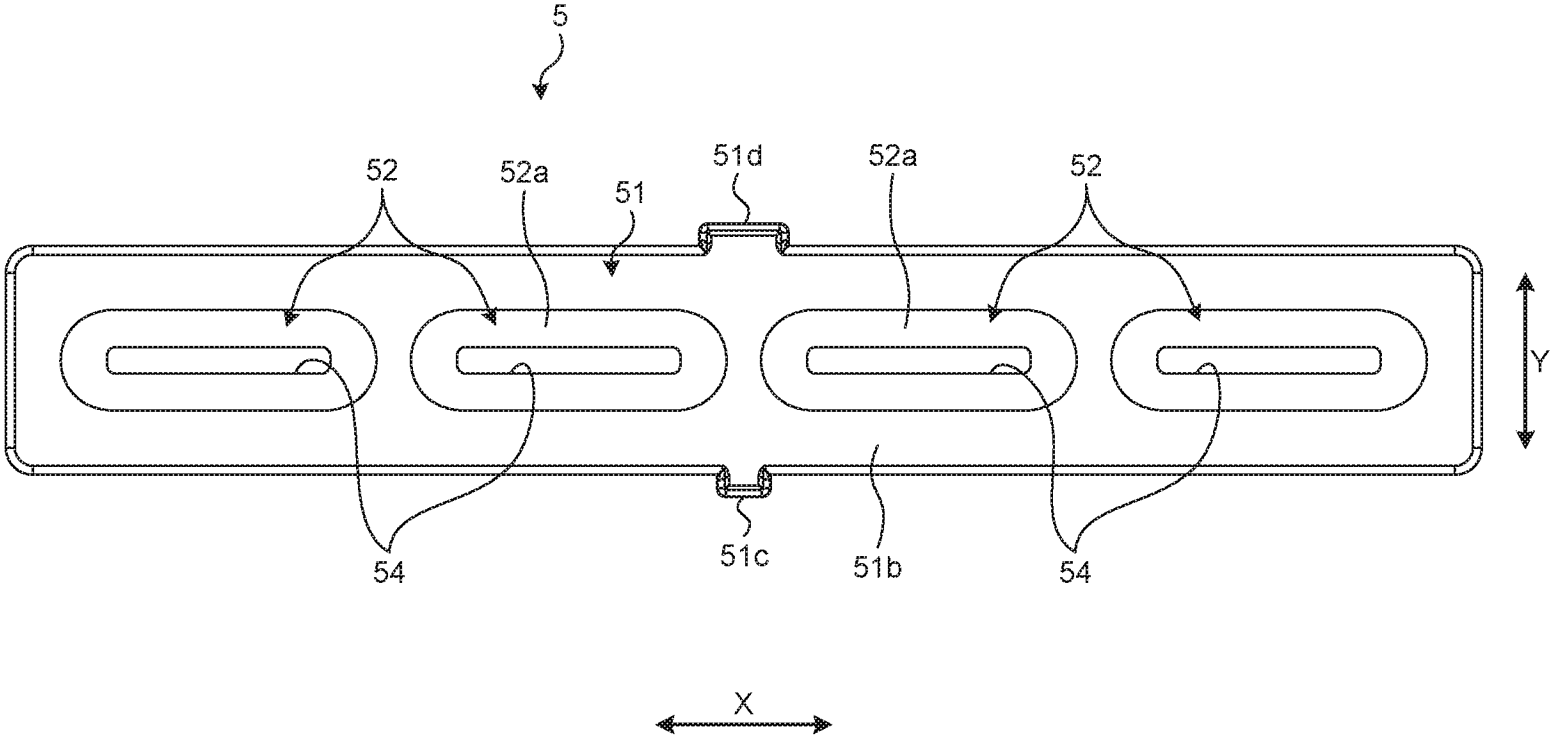
FIG. 15 is a bottom view of the support member according to the embodiment.
Figure 16:
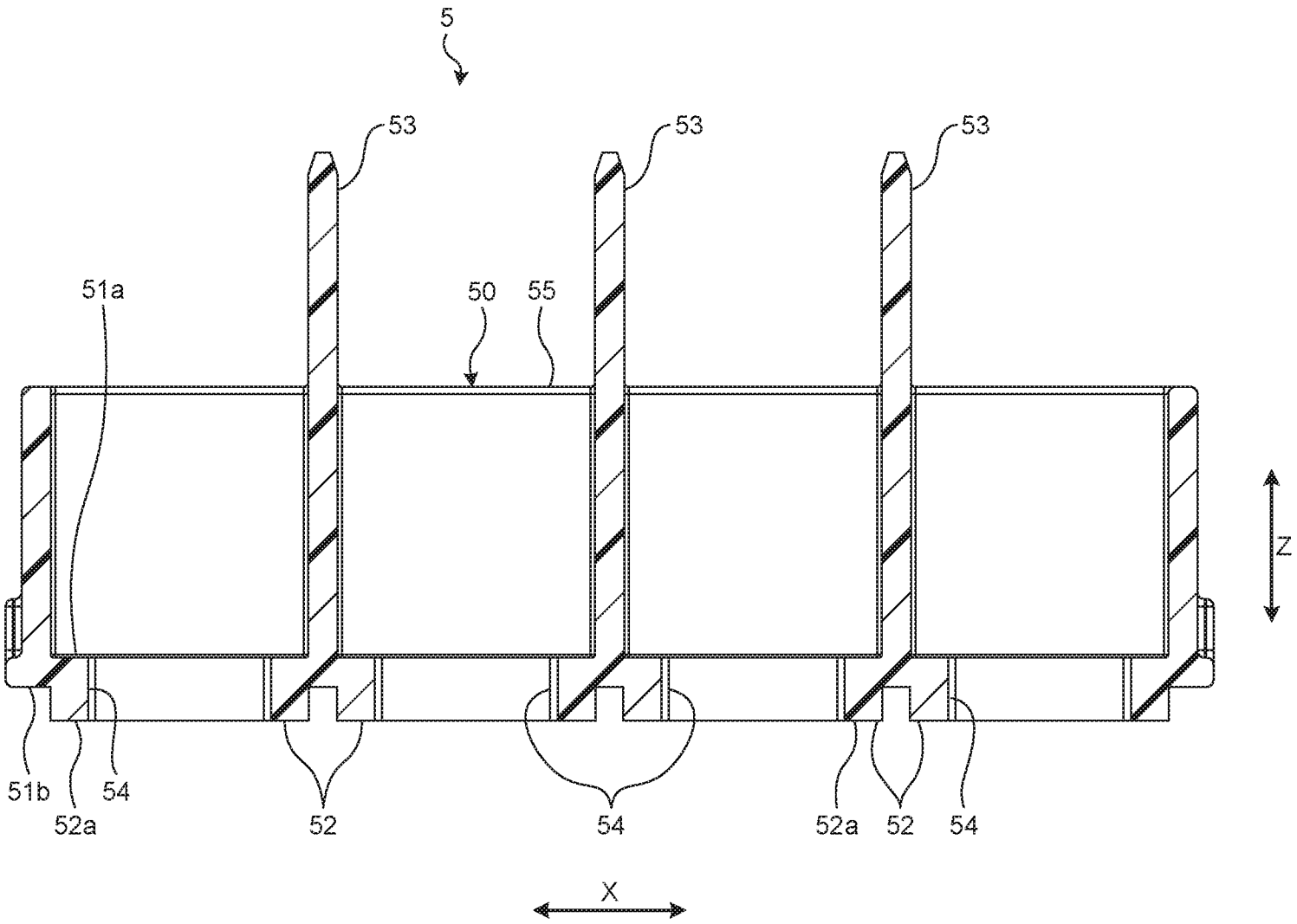
FIG. 16 is a sectional view of the support member according to the embodiment.
Figure 17:
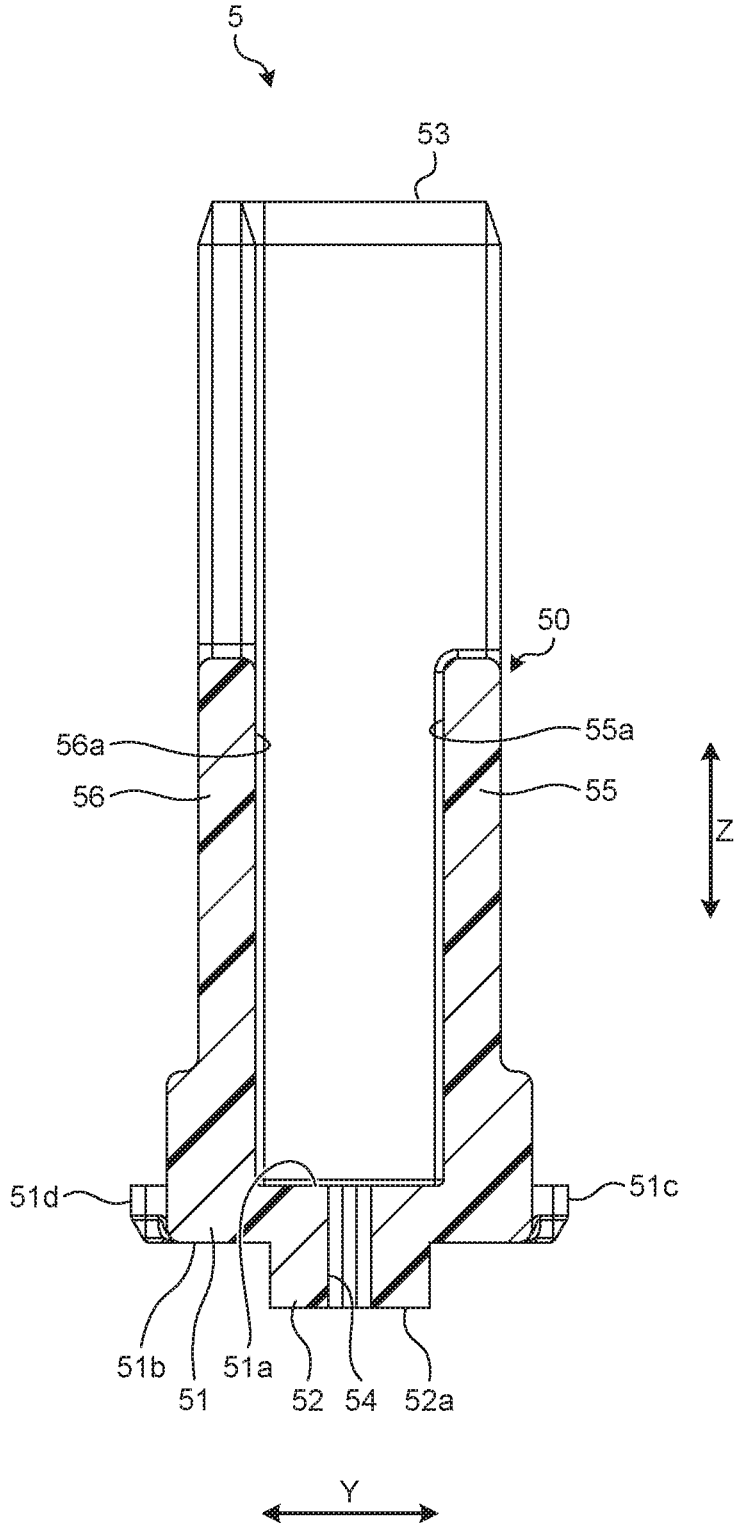
FIG. 17 is another sectional view of the support member according to the embodiment.
Figure 18:
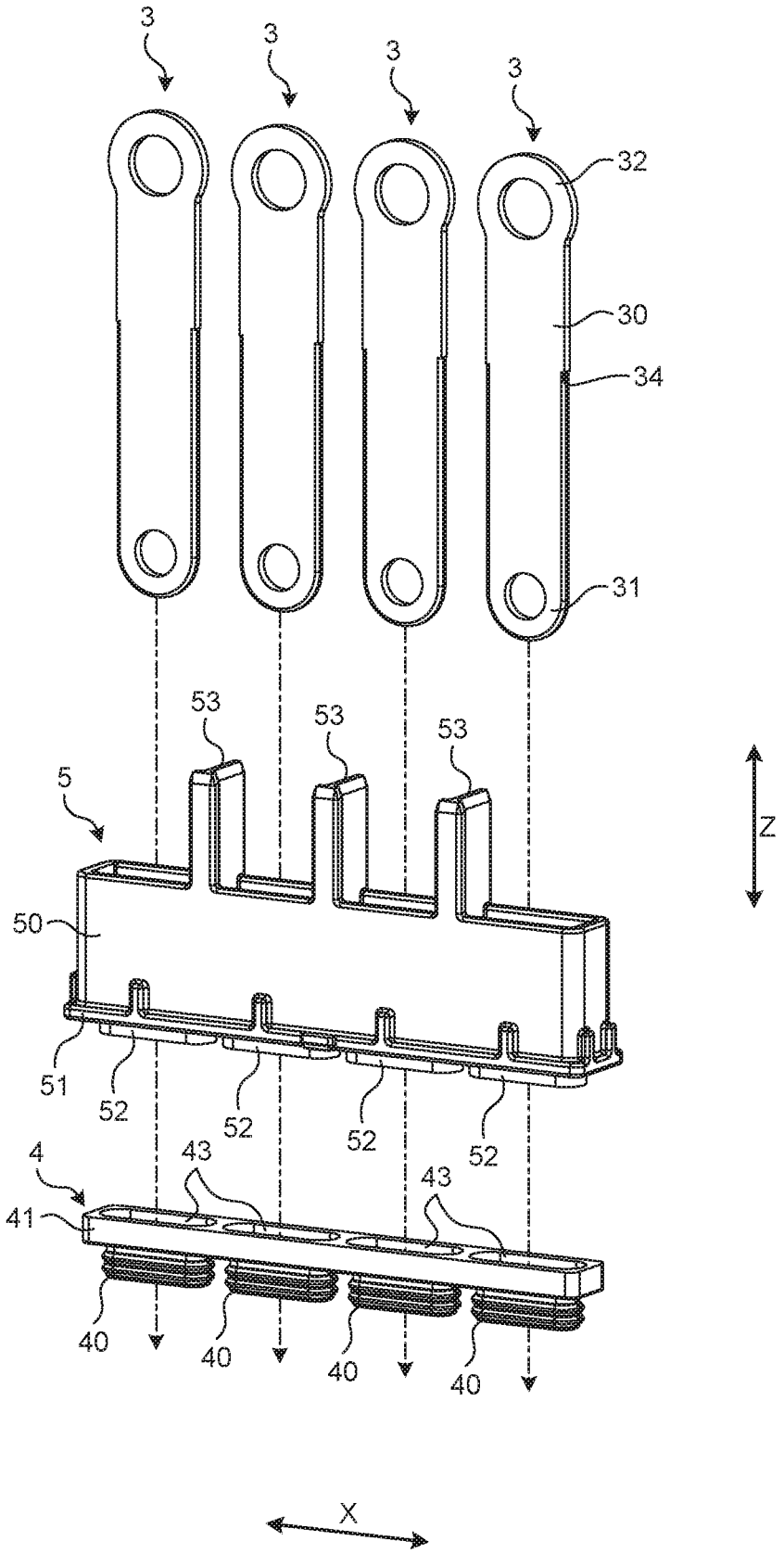
FIG. 18 is a perspective view for explaining assembly of a conductor unit.
Figure 19:
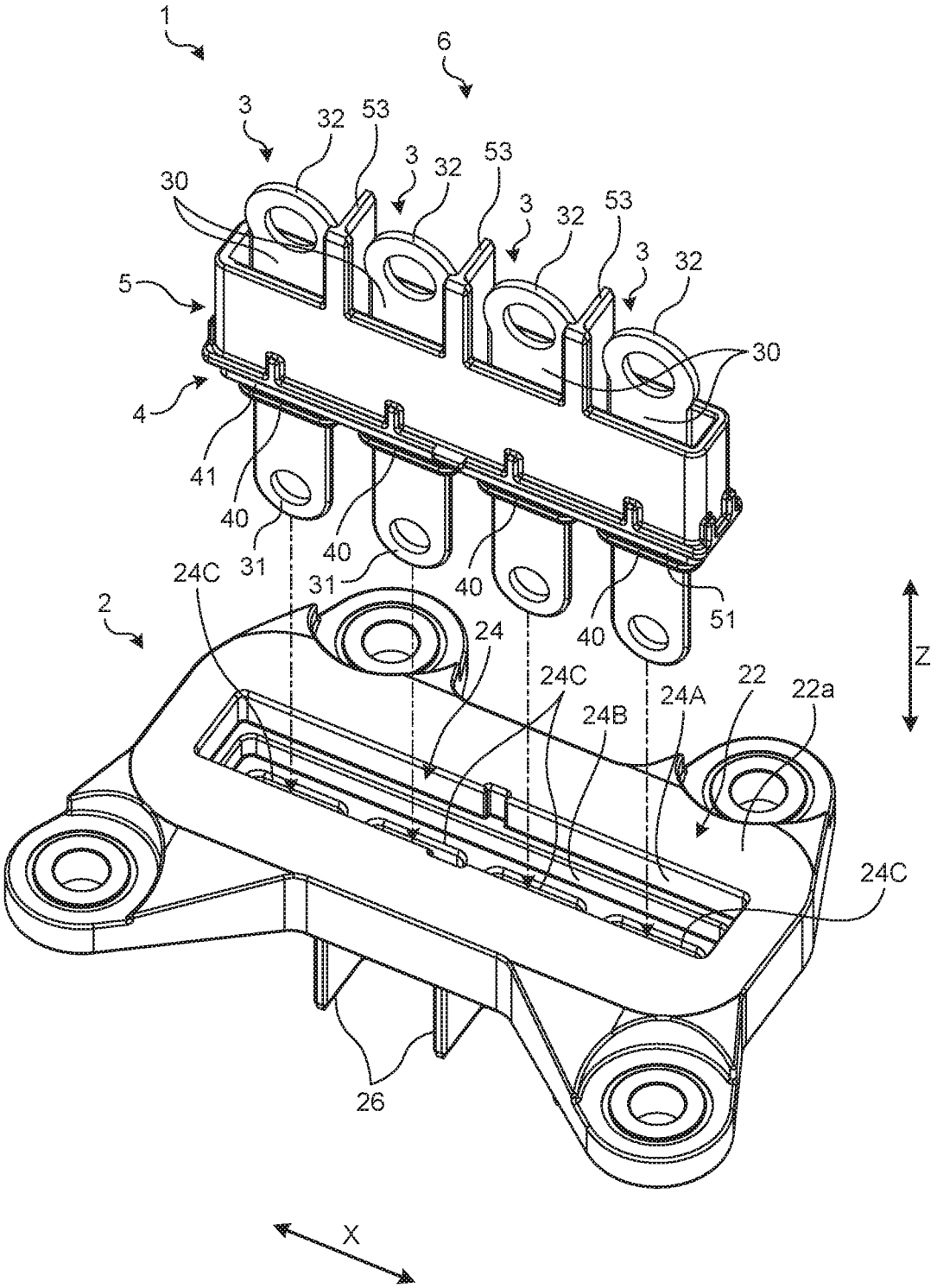
FIG. 19 is a perspective view for explaining assembly of the conductor unit with respect to the housing.
Figure 20:
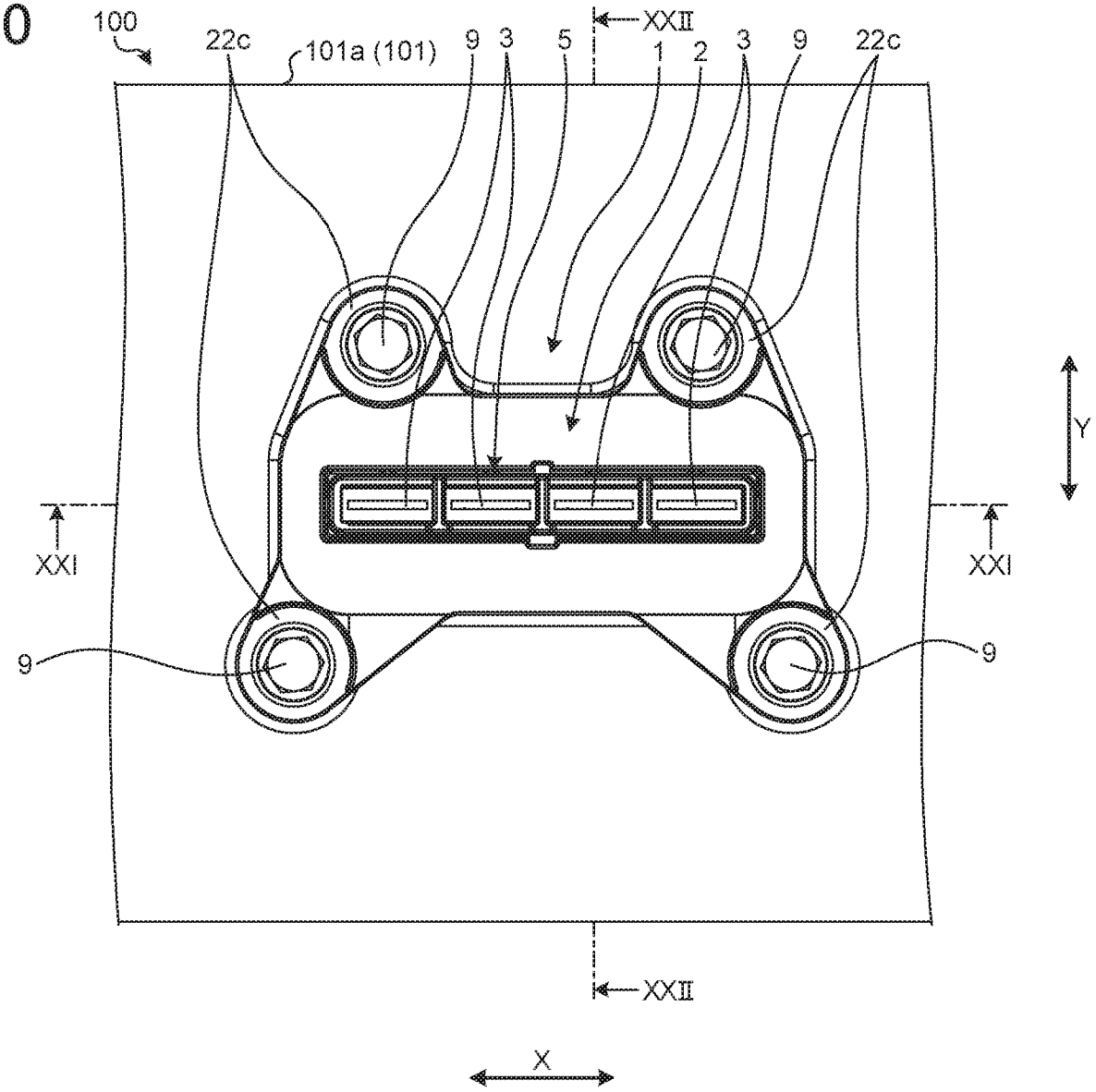
FIG. 20 is a plan view illustrating the connector attached to the first device.
Figure 21:
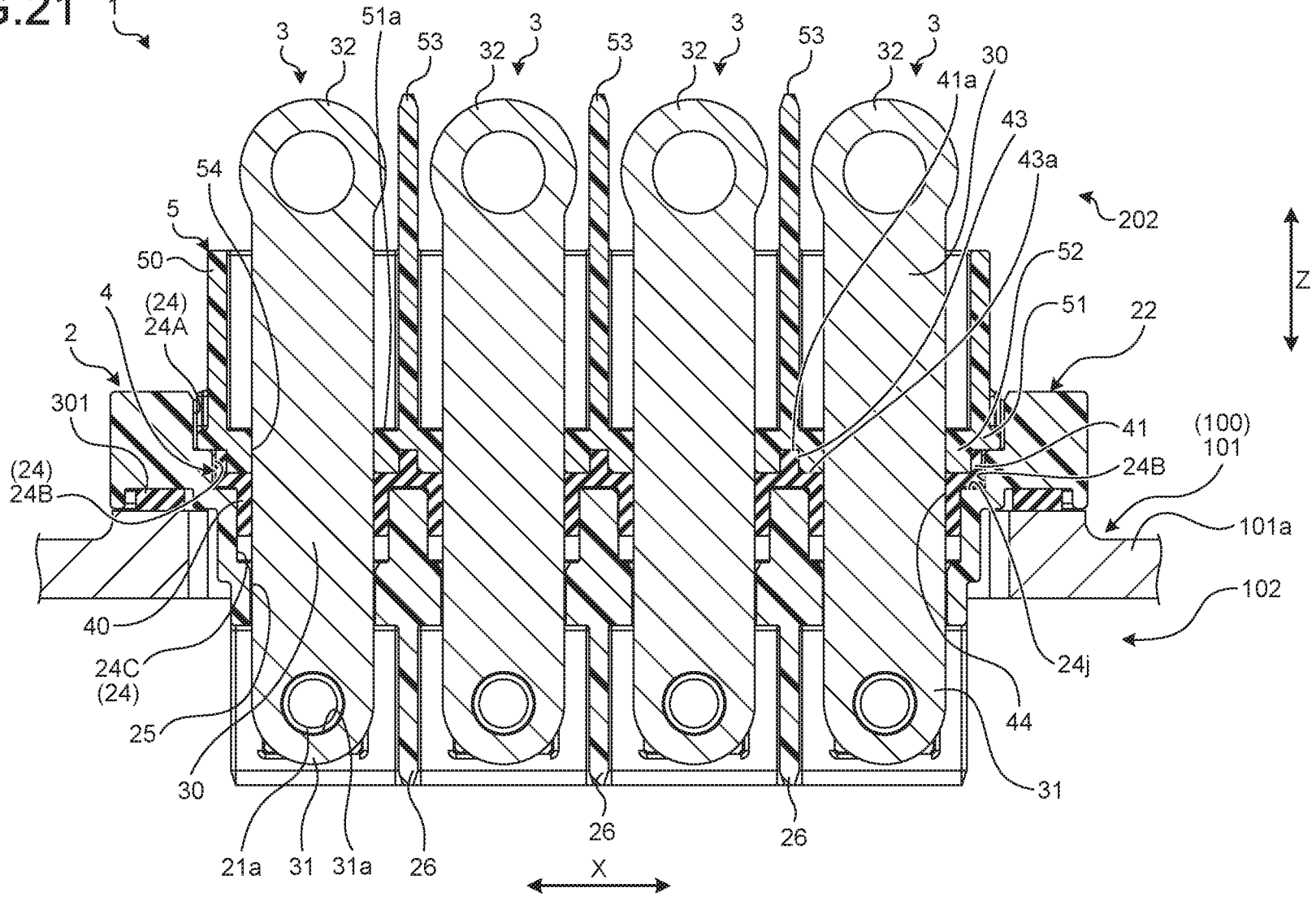
FIG. 21 is a sectional view of the connector according to the embodiment.
Figure 22:
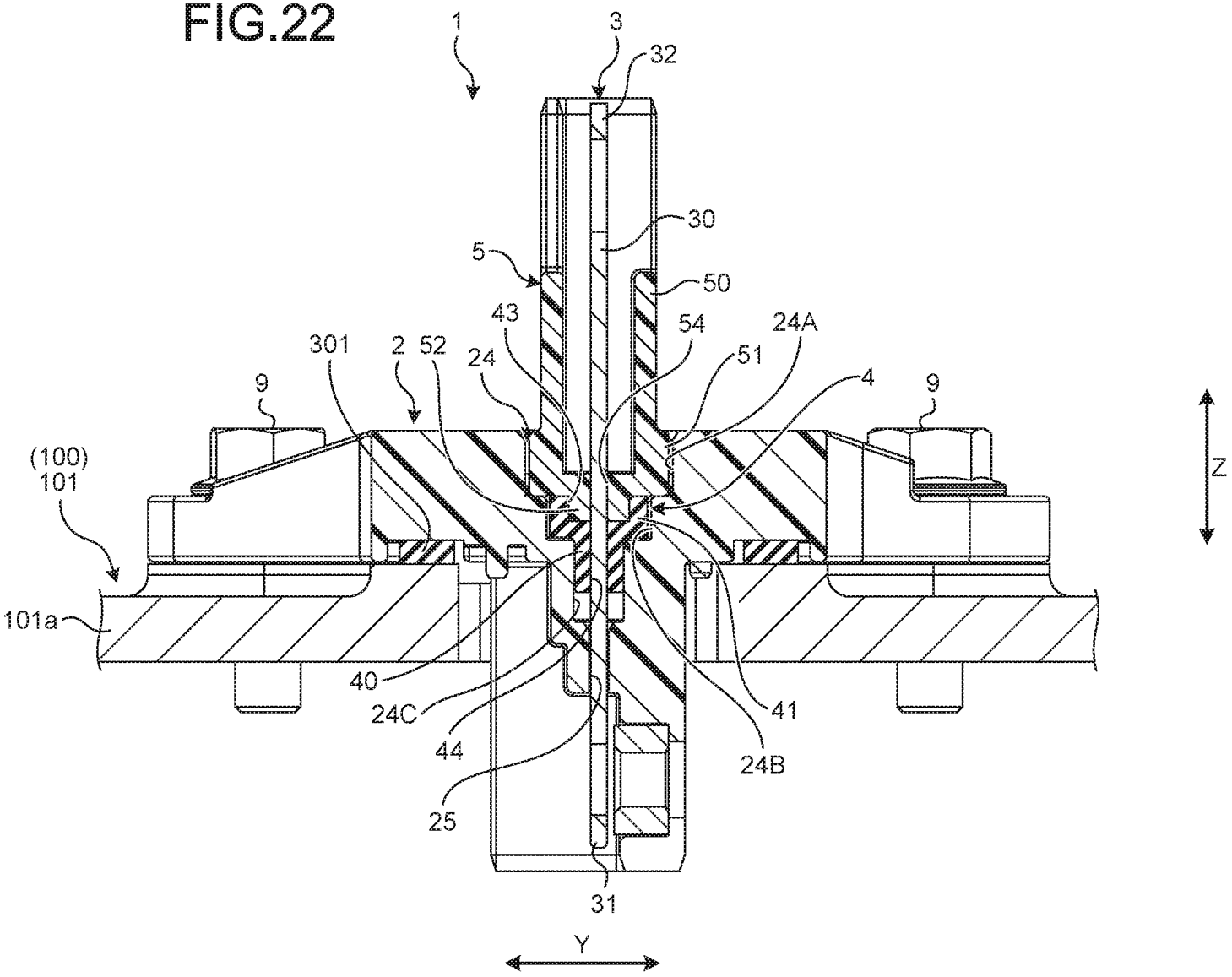
FIG. 22 is another sectional view of the connector according to the embodiment.
Figure 23:
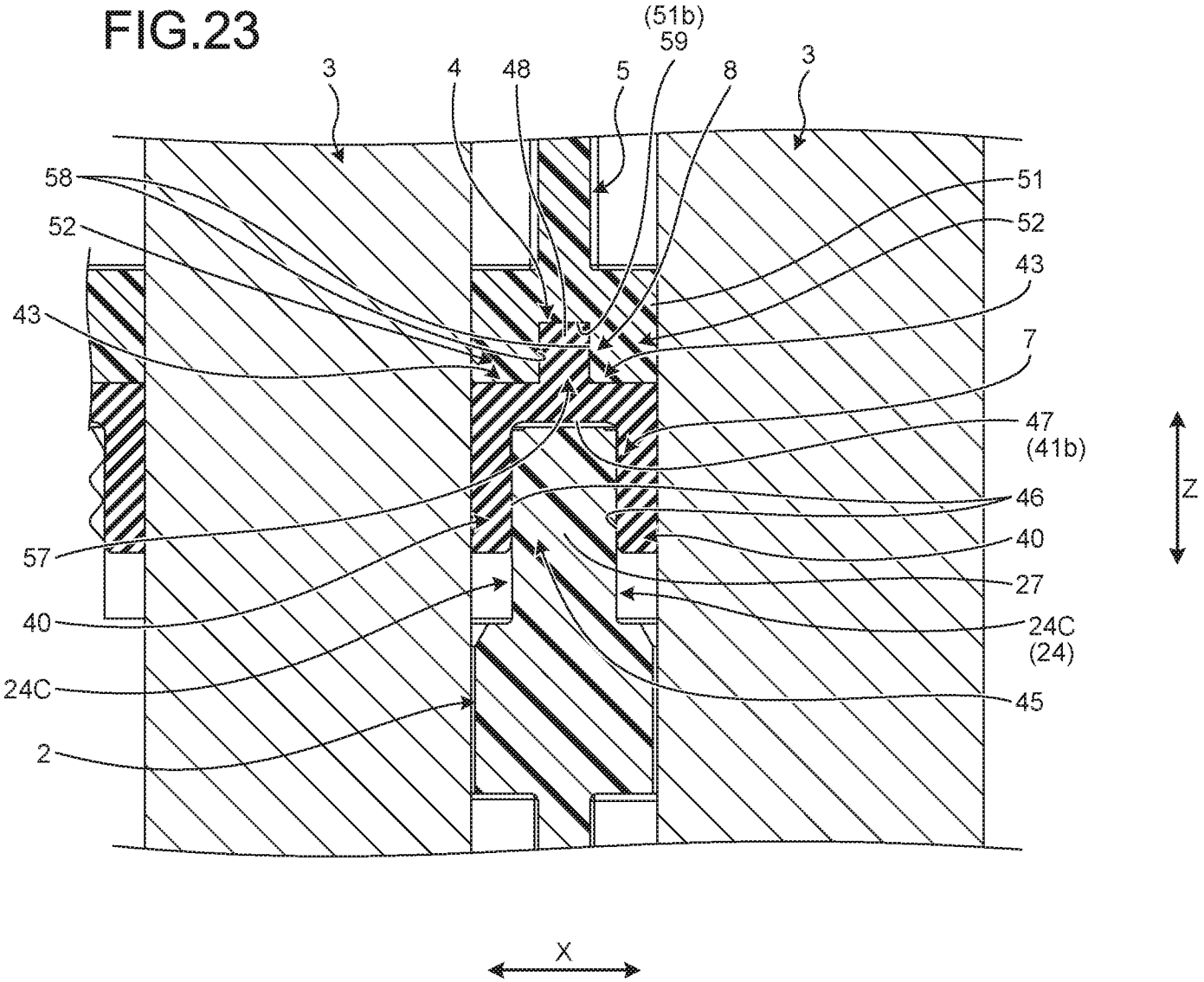
FIG. 23 is an enlarged sectional view of the connector according to the embodiment.

FIG. 12 is a plan view of a support member according to the embodiment, FIG. 13 is a front view of the support member according to the embodiment, FIG. 14 is a side view of the support member according to the embodiment, FIG. 15 is a bottom view of the support member according to the embodiment, FIG. 16 is a sectional view of the support member according to the embodiment, FIG. 17 is another sectional view of the support member according to the embodiment, FIG. 18 is a perspective view for explaining assembly of a conductor unit, FIG. 19 is a perspective view for explaining assembly of the conductor unit with respect to the housing, FIG. 20 is a plan view illustrating the connector attached to the first device, FIG. 21 is a sectional view of the connector according to the embodiment, FIG. 22 is another sectional view of the connector according to the embodiment, and FIG. 23 is an enlarged sectional view of the connector according to the embodiment.

Figure 3:
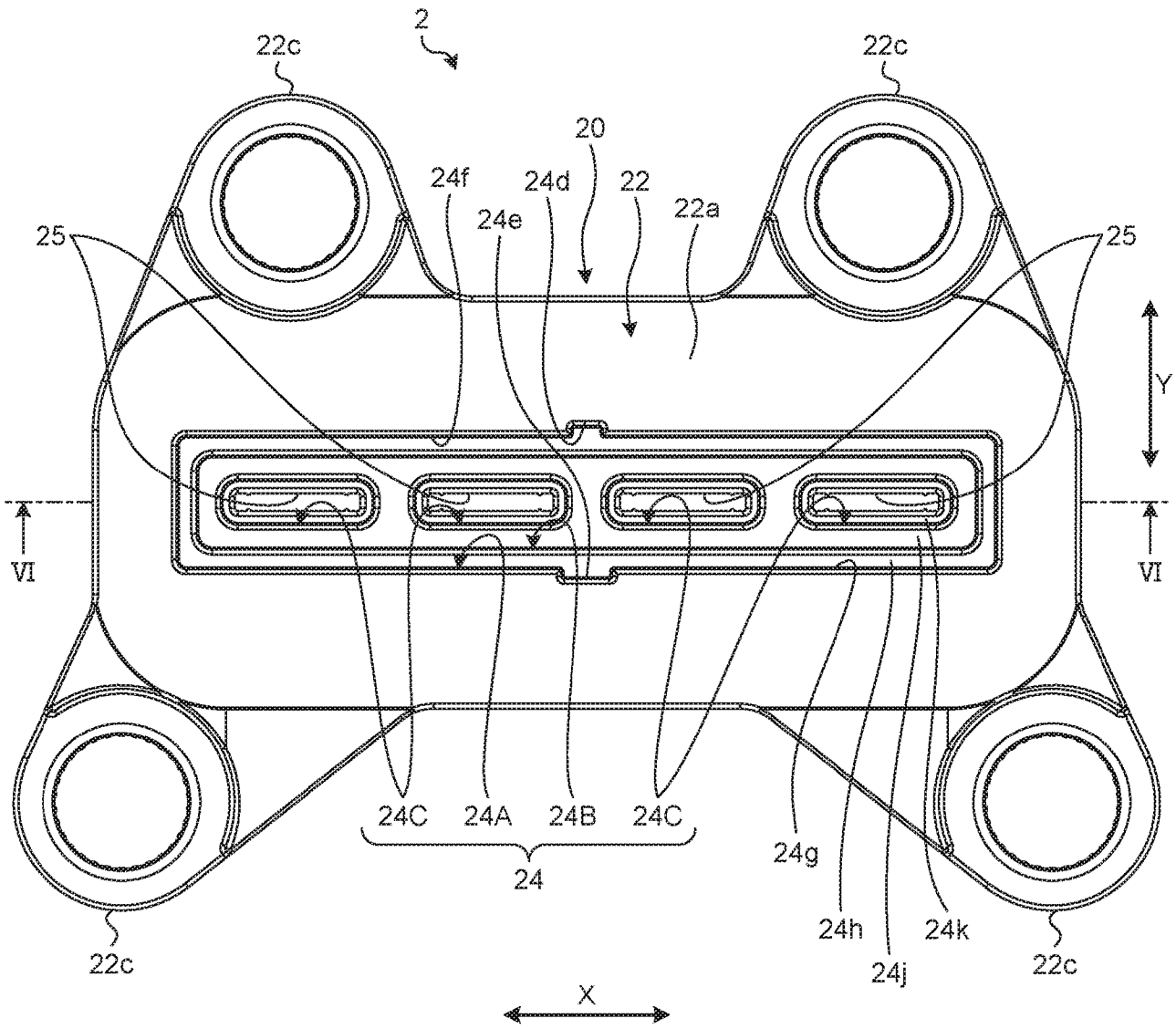
FIG. 3 is a plan view of a housing according to the embodiment.
Figure 6:
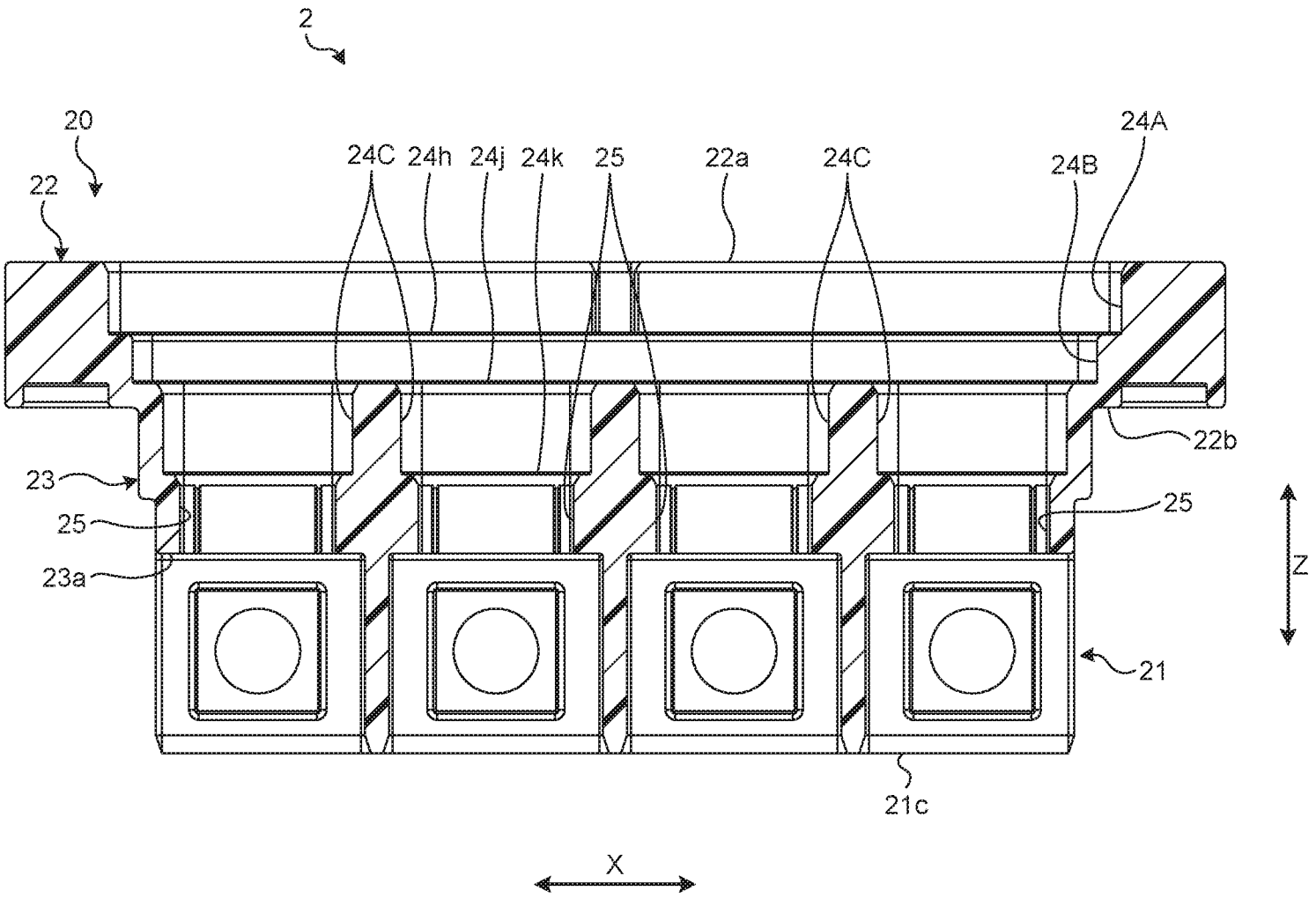
FIG. 6 is a sectional view of the housing according to the embodiment.

FIG. 6 illustrates a section taken along line VI-VI of FIG. 3. FIG. 7 illustrates a section taken along line VII-VII of FIG. 4. FIG. 10 illustrates a section taken along line X-X of FIG. 9. FIG. 11 illustrates a section taken along line XI-XI of FIG. 8. FIG. 16 illustrates a section taken along line XVI-XVI of FIG. 12. FIG. 17 illustrates a section taken along line XVII-XVII of FIG. 12. FIG. 21 illustrates a section taken along line XXI-XXI of FIG. 20.

Figure 2:
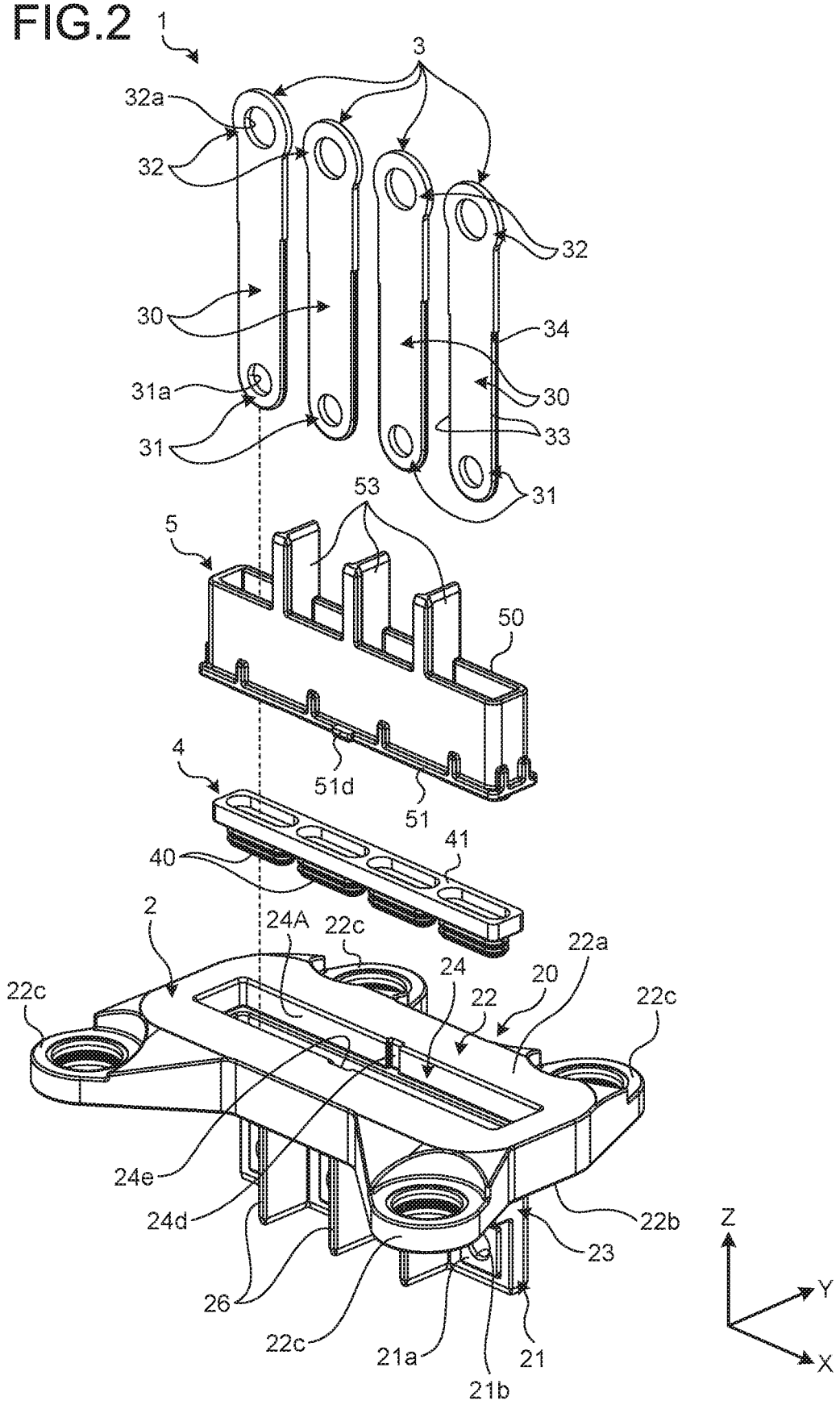
FIG. 2 is an exploded perspective view of the connector according to the embodiment.

As illustrated in FIG. 1 and FIG. 2, a connector 1 according to the embodiment has a housing 2, a plurality of conductors 3, a sealing member 4, and a support member 5. The connector 1 electrically connects a first device 100 and a second device 200. In the present embodiment, the first device 100 is a motor and the second device 200 is an inverter. The first device 100 and the second device 200 are mounted on a vehicle such as an automobile, for example. A motor body 103 of the first device 100 and an inverter body 203 of the second device 200 are electrically connected via the conductors 3.

The second device 200 is interposed between a battery mounted on the vehicle and the first device 100. The second device 200 has a conversion function between a direct current and an alternating current and a transformation function of increasing and decreasing a voltage. The supply of electric power from the battery to the first device 100 is controlled by the second device 200. Furthermore, electric power generated by regeneration in the first device 100 is stored in the battery via the second device 200.

The first device 100 has a casing 101 and the motor body 103. The motor body 103 is a main component of the first device 100 and includes a rotor and a stator. The motor body 103 is disposed in an internal space 102 of the casing 101. In the internal space 102 of the casing 101, a first liquid 104 is stored. The first liquid 104 is a liquid having a lubricating function and a cooling function for the motor body 103, and is, for example, oil. An upper wall part 101*a* of the casing 101 has an opening 101*b*. The opening 101*b* penetrates the wall part 101*a* and allows the internal space 102 of the casing 101 and an external space of the casing 101 to communicate with each other.

The second device 200 has a casing 201 and the inverter body 203. The inverter body 203 is a main component of the second device 200 and includes a switching circuit. The inverter body 203 is disposed in an internal space 202 of the casing 201. A pipe 204 is provided in the internal space 202 of the casing 201. A second liquid 205 for cooling is supplied to the inverter body 203 via the pipe 204. The second liquid 205 is, for example, cooling water. A lower wall part 201*a* of the casing 201 has an opening 201*b*.

The casing 101 and the casing 201 are fixed to each other with the opening 101*b* and the opening 201*b* facing each other. A gasket 300 is interposed between the wall part 101*a* of the casing 101 and the wall part 201*a* of the casing 201.

The connector 1 is fixed to the casing 101 of the first device 100 at a communication part 10 through which the opening 101*b* of the first device 100 and the opening 201*b* of the second device 200 communicate with each other. The communication part 10 is a part where the opening 101*b* of the first device 100 and the opening 201*b* of the second device 200 face each other. In the present embodiment, the opening 201*b* of the second device 200 is larger than the opening 101*b* of the first device 100. Accordingly, the wall part 101*a* of the first device 100 is exposed toward the internal space 202 of the second device 200.

As illustrated in FIG. 1 and FIG. 2, each of the conductors 3 of the present embodiment is a bus bar. The number of the conductors 3 included in the connector 1 of the present embodiment is four. However, the number of the conductors 3 is not limited to four. The conductor 3 is made of a conductive metal, for example, copper, aluminum, and the like. The conductor 3 is formed, for example, by being punched out from a metal plate as a base material. The conductor 3 has a body 30, a first terminal part 31, and a second terminal part 32. The body 30 has a rectangular plate shape.

The first terminal part 31 is connected to one end of the body 30 in a longitudinal direction. The first terminal part 31 is electrically connected to a terminal included in the first device 100. The first terminal part 31 has a circular shape, for example. The outer diameter of the first terminal part 31 is equal to the width of the body 30. The first terminal part 31 has a through hole 31*a* into which a fastening member is inserted. The second terminal part 32 is connected to the other end of the body 30 in the longitudinal direction. The second terminal part 32 is electrically connected to a terminal included in the second device 200. The second terminal part 32 has a circular shape, for example. The second terminal part 32 has a through hole 32*a* into which a fastening member is inserted. The outer diameter of the second terminal part 32 is larger than that of the first terminal part 31. Furthermore, the outer diameter of the second terminal part 32 is larger than the width of the body 30.

A chamfered part 33 is formed on a part of the body 30 and the first terminal part 31. The chamfered part 33 is formed on both edges of the body 30 and the first terminal part 31 in a width direction. The chamfered part 33 has a sectional arc shape, for example. The body 30 has a stopper 34. The stopper 34 is a stepped part at the boundary between a part of the body 30 where the chamfered part 33 is provided and a part where the chamfered part 33 is not provided. The stopper 34 abuts the support member 5 and locks the support member 5.

Each of the conductors 3 is inserted into the housing 2 with the first terminal part 31 as a head. In the present embodiment, the longitudinal direction of the conductor 3 is referred to as a "height direction Z". Furthermore, a direction in which the conductors 3 are arranged is referred to as a "first direction X". The first direction X is orthogonal to the height direction Z. A direction orthogonal to both the first direction X and the height direction Z is referred to as a "second direction Y". The second direction Y is a plate thickness direction of the conductor 3.

As illustrated in FIG. 2, the housing 2 has a body 20 and a wall part 21. The body 20 and the wall part 21 are integrally molded of an insulating synthetic resin, for example. The material of the housing 2 is resistant to the first liquid 104. The material of the housing 2 is, for example, an oil-resistant synthetic resin. The body 20 is a part fixed to the wall part 101*a* of the first device 100. The body 20 has a base 22 formed in a plate shape and a protruding part 23 protruding toward the height direction Z from the base 22. The wall part 21 protrudes toward the height direction Z from a tip end of the protruding part 23.

As illustrated in FIG. 3, the base 22 has a substantially planar rectangular shape. The longitudinal direction of the base 22 is the first direction X. The base 22 is provided at the four corners thereof with fixed parts 22*c* each having through holes. The fixed parts 22*c* are fixed to the wall part 101*a* of the first device 100 by, for example, bolts 9 (see FIG. 20). The base 22 has a first surface 22*a* and a second surface 22*b*. The second surface 22*b* is a surface on which the protruding part 23 is provided. The first surface 22*a* is a surface opposite to the second surface 22*b*. The base 22 is fixed with the first surface 22*a* facing the second device 200 and with the second surface 22*b* facing the wall part 101*a*. The first surface 22*a* faces upward when the first device 100 and the second device 200 are installed in a vehicle, for example.

As illustrated in FIG. 4 and FIG. 5, the protruding part 23 protrudes toward the height direction Z from the second surface 22*b* of the base 22. The protruding part 23 has a substantially rectangular parallelepiped shape. The protruding part 23 in a section orthogonal to the height direction Z has a substantially sectional rectangular shape. In the sectional shape of the protruding part 23, the longitudinal direction is the first direction X.

As illustrated in FIG. 2 and FIG. 3, the body 20 has a recess 24 formed in multiple stages. The recess 24 is opened to the first surface 22*a* of the base 22 and is recessed toward the wall part 21 along the height direction Z. The recess 24 has a first recess 24A, a second recess 24B, and third recesses 24C. The first recess 24A is fitted to the support member 5 and supports the support member 5 from below. The second recess 24B and the third recesses 24C are fitted to the sealing member 4 and supports the sealing member 4 from below.

As illustrated in FIG. 3, the first recess 24A has a substantially planar rectangular shape. The longitudinal direction of the first recess 24A is the first direction X. The first recess 24A has a first wall surface 24*f* and a second wall surface 24*g* facing each other in the second direction Y. The first wall surface 24*f* and the second wall surface 24*g* are surfaces along the first direction X and the height direction Z.

The first recess 24A has a first groove 24*d* and a second groove 24*e*. The first groove 24*d* and the second groove 24*e* restrict the direction when the support member 5 is attached to the housing 2, and prevent erroneous assembly. The first groove 24*d* and the second groove 24*e* extend along the height direction Z. The first groove 24*d* is provided on the first wall surface 24*f*. The second groove 24*e* is provided on the second wall surface 24*g*. The first groove 24*d* and the second groove 24*e* face each other in the second direction Y. The groove width of the first groove 24*d* is smaller than that of the second groove 24*e*.

The second recess 24B is recessed along the height direction Z from a bottom surface 24*h* of the first recess 24A toward the wall part 21 side. The second recess 24B has a substantially planar rectangular shape. The longitudinal direction of the second recess 24B is the first direction X. The third recesses 24C are recessed along the height direction Z from a bottom surface 24*j* of the second recess 24B toward the wall part 21 side. The recess 24 of the present embodiment has a plurality of third recesses 24C. The number of the third recesses 24C is set to four in accordance with the number of the conductors 3. The four third recesses 24C are arranged in a row along the first direction X. The four third recesses 24C are disposed at equal intervals, for example. Each of the third recesses 24C has a substantially planar rectangular shape. The longitudinal direction of the third recess 24C is the first direction X.

As illustrated in FIG. 3, the body 20 has a plurality of first through holes 25. The conductors 3 are press-fitted into the first through holes 25 and held by the first through holes 25.

Each of the first through holes 25 has a sectional shape corresponding to that of the conductor 3, and has a rectangular shape, for example. The longitudinal direction in the sectional shape of the first through hole 25 is the first direction X. The number of the first through holes 25 included in the body 20 is four in accordance with the number of the conductors 3 to be inserted. The first through holes 25 are disposed at equal intervals along the first direction X.

The first through holes 25 penetrate the body 20 along the height direction Z. One end of the first through hole 25 is opened to a bottom surface 24*k* of the third recess 24C. The other end of the first through hole 25 is opened to a tip end surface 23*a* of the protruding part 23. One first through hole 25 is disposed for one third recess 24C. Note that the recess 24 and the first through holes 25 may be combined and regarded as a continuous through hole. In such a case, the through hole is understood as a multi-step through hole whose sectional area gradually decreases from the first surface 22*a* of the base 22 to the tip end surface 23*a* of the protruding part 23.

The wall part 21 is a rectangular flat plate-shaped component part and protrudes toward the height direction Z from the tip end surface 23*a* of the protruding part 23. As illustrated in FIG. 4, FIG. 7 and the like, the wall part 21 holds nuts 21*a*. Four nuts 21*a* are fixed to the wall part 21 of the present embodiment in correspondence with the four conductors 3. The nuts 21*a* are integrally formed with the wall part 21 by molding, for example. A screw hole 21*b* of each of the nuts 21*a* extends along the second direction Y. The first terminal part 31 of the conductor 3 and a terminal 105 of the first device 100 are co-fastened to the nut 21*a* by a bolt.

The housing 2 has a plurality of insulating walls 26. Each of the insulating walls 26 is a wall that partitions the adjacent conductors 3. The housing 2 of the present embodiment has three insulating walls 26 in correspondence with the four conductors 3. The insulating walls 26 protrude toward the second direction Y from the side surface of the protruding part 23 and the wall part 21. The insulating walls 26 extend along the height direction Z from the second surface 22*b* of the base 22 to a tip end surface 21*c* of the wall part 21.

As illustrated in FIG. 8 to FIG. 11, the sealing member 4 has a plurality of sealing parts 40 and a connecting part 41. The sealing member 4 is an insulating member having a mat seal shape in which a plurality of O-rings are connected in series. The sealing member 4 of the present embodiment has four sealing parts 40 in correspondence with the four conductors 3. The four sealing parts 40 are disposed in a row along the first direction X. The four sealing parts 40 are disposed at equal intervals, for example. The sealing parts 40 and the connecting part 41 are integrally molded of a resin such as rubber. The material of the sealing member 4 is a material having resistance to the first liquid 104, and is, for example, oil-resistant silicon rubber and the like.

The sealing parts 40 seal between the conductors 3 and the housing 2. The shape of each of the sealing parts 40 is annular, for example, tubular. The sectional shape of the sealing part 40 of the present embodiment is elliptical or rectangular. The longitudinal direction of the sealing part 40 is the first direction X. The sealing part 40 is a shaft seal whose inner peripheral surface is in close contact with the conductor 3 and whose outer peripheral surface is in close contact with the housing 2. The sealing part 40 is provided on the outer peripheral surface thereof with an annular lip 42.

As illustrated in FIG. 8 and the like, the connecting part 41 has a flat plate shape. The connecting part 41 has a first surface 41*a* and a second surface 41*b*. The first surface 41*a* is a surface facing the second device 200. The first surface 41*a* faces upward when the first device 100 and the second device 200 are installed in a vehicle, for example. The second surface 41*b* is a surface opposite to the first surface 41*a*. The second surface 41*b* faces downward when the first device 100 and the second device 200 are installed in a vehicle, for example. The sealing parts 40 protrude toward the height direction Z from the second surface 41*b*.

As illustrated in FIG. 2 and FIG. 10, the connecting part 41 has recesses 43. Protrusions 52 of the support member 5 are inserted in the recesses 43. The connecting part 41 of the present embodiment has four recesses 43 in correspondence with the four conductors 3. The four recesses 43 are arranged in a row along the first direction X. The four recesses 43 are disposed at equal intervals, for example. The recesses 43 are recessed along the height direction Z from the first surface 41*a* toward the second surface 41*b*. That is, the recesses 43 are opened toward the height direction Z on the first surface 41*a*. In the plan view, each of the recesses 43 has a substantially elliptical shape. The longitudinal direction of the recess 43 is the first direction X.

The sealing member 4 has a plurality of through holes 44 into which the conductors 3 are inserted. Each of the through holes 44 has a substantially sectional rectangular shape. The longitudinal direction in the sectional shape of the through hole 44 is the first direction X. The sealing member 4 has four through holes 44 in correspondence with the four conductors 3. The four through holes 44 are disposed at equal intervals, for example. The through holes 44 penetrate the connecting part 41 and the sealing parts 40 along the height direction Z. One end of the through hole 44 is opened to a bottom surface 43*a* of the recess 43. The other end of the through hole 44 is opened to a tip end surface 40*a* of the sealing part 40. One through hole 44 is disposed for one sealing part 40. Note that the recess 43 and the through holes 44 may be combined and regarded as one continuous through hole. In such a case, the through hole is understood as a through hole that penetrates from the first surface 41*a* of the connecting part 41 to the tip end surface 40*a* of the sealing part 40 and has a smaller sectional area on the tip end surface 40*a* side than the bottom surface 43*a*.

As illustrated in FIG. 12 to FIG. 17, the support member 5 has a tubular part 50, a bottom wall part 51, the protrusions 52, and insulating walls 53. The support member 5 of the present embodiment is an integral mat seal stopper in which a plurality of O-ring stoppers are connected in series. The tubular part 50, the bottom wall part 51, the protrusions 52, and the insulating walls 53 are integrally molded of an insulating synthetic resin, for example. The material of the support member 5 is resistance to the second liquid 205. Note that the material of the support member 5 may be a material not resistance to the first liquid 104 or a material having low resistance to the first liquid 104, compared with the material of the housing 2.

The tubular part 50 has a rectangular tubular shape. The outer shape of the tubular part 50 in the plan view is a rectangle. The longitudinal direction of the tubular part 50 is the first direction X. The tubular part 50 has a first wall part 55 and a second wall part 56 facing each other in the second direction Y.

The bottom wall part 51 is a wall part that closes one opening of the tubular part 50. An inner surface 51*a* of the bottom wall part 51 is a surface facing the second device 200. The inner surface 51*a* is a surface facing upward when the first device 100 and the second device 200 are installed in a vehicle, for example. The bottom wall part 51 is provided on the side surface thereof with a first lib 51*c* and a second lib 51*d* protruding toward the second direction Y. The first lib 51*c* is disposed on an edge of the bottom wall part 51 on the first wall part 55 side. The second lib 51*d* is disposed on an edge of the bottom wall part 51 on the second wall part 56 side. The first lib 51*c* is guided by the first groove 24*d* of the housing 2. The second lib 51*d* is guided by the second groove 24*e* of the housing 2. In the first direction X, the width of the first lib 51*c* is smaller than that of the second lib 51*d*.

As illustrated in FIG. 13 to FIG. 17, the protrusions 52 protrude along the height direction Z from an outer surface 51*b* of the bottom wall part 51. The protrusions 52 serve as O-ring stoppers that support the sealing parts 40. The support member 5 of the present embodiment has four protrusions 52 in correspondence with the four conductors 3. The four protrusions 52 are arranged in a row along the first direction X. The four protrusions 52 are disposed at equal intervals, for example. As illustrated in FIG. 15, in the plan view, the protrusion 52 has an elliptical shape. The shape of the protrusion 52 corresponds to the shape of the recess 43 of the sealing member 4 and the shape of the sealing part 40.

The support member 5 has a plurality of second through holes 54 into which the conductors 3 are inserted. Each of the second through holes 54 has a substantially sectional rectangular shape. The longitudinal direction in the sectional shape of the second through hole 54 is the first direction X. The support member 5 has four second through holes 54 in correspondence with the four conductors 3. The four second through holes 54 are arranged along the first direction X. The four second through holes 54 are disposed at equal intervals, for example. The second through holes 54 penetrate the bottom wall part 51 and the protrusions 52 along the height direction Z. One end of the second through hole 54 is opened to the inner surface 51*a* of the bottom wall part 51. The other end of the second through hole 54 is opened to a tip end surface 52*a* of the protrusion 52. One second through hole 54 is disposed for one protrusion 52.

The insulating walls 53 are walls that partition the adjacent conductors 3. The insulating walls 53 are connected to an inner surface 55*a* of the first wall part 55, an inner surface 56*a* of the second wall part 56, and the inner surface 51*a* of the bottom wall part 51, and divide the internal space of the tubular part 50. Furthermore, each of the insulating walls 53 has a protruding part 53*a* protruding from the tubular part 50 along the height direction Z.

The connector 1 of the present embodiment is assembled as follows, for example. First, as illustrated in FIG. 18, the sealing member 4, the support member 5, and the conductors 3 are assembled together. Specifically, the protrusions 52 of the support member 5 are inserted into the recesses 43 of the sealing member 4. With this, the connecting part 41 of the sealing member 4 is attached to the support member 5. Furthermore, the conductors 3 are inserted into the second through holes 54 of the support member 5 and the through holes 44 of the sealing member 4. The conductors 3 are inserted into the four pairs of through holes 54 and 44, respectively. With this, as illustrated in FIG. 19, a conductor unit 6 in which the conductors 3, one support member 5, and one sealing member 4 are assembled is formed.

In the conductor unit 6, each of the insulating walls 53 partitions the adjacent two conductors 3. More specifically, the insulating walls 53 protrude with respect to the tip end of the second terminal part 32 along the height direction Z. That is, the insulating walls 53 conceal the entire second terminal part 32 from the entire adjacent second terminal part 32.

As illustrated in FIG. 19, the conductor unit 6 is attached to the housing 2. The sealing member 4 and the support member 5 serve as a guide for guiding the conductors 3 to the first through holes 25 of the housing 2. That is, the sealing member 4 and the support member 5 can allow the multipolar conductors 3 to be inserted into the first through holes 25 at the same time. As illustrated in FIG. 19, in the conductor unit 6, the first terminal parts 31 are first inserted into the recesses 24 of the housing 2. The sealing parts 40 of the sealing member 4 are inserted into the third recesses 24C of the housing 2. The connecting part 41 of the sealing member 4 is inserted into the second recess 24B. The connecting part 41 is received in the second recess 24B of the housing 2 and supported by the bottom surface 24*j* of the second recess 24B. The bottom wall part 51 of the support member 5 is inserted into the first recess 24A of the housing 2. The conductors 3 are press-fitted into the first through holes 25 of the housing 2, so that the conductor unit 6 is held by the housing 2.

FIG. 20 illustrates the connector 1 attached to the casing 101 of the first device 100. The housing 2 of the connector 1 is fixed to the upper wall part 101*a* by the bolts 9. Between the housing 2 and the wall part 101*a*, for example, a face seal 301 is interposed.

As illustrated in FIG. 21 and FIG. 22, the sealing part 40 is interposed between the conductor 3 and the third recess 24C. The inner peripheral surface of the sealing part 40 is in close contact with the body 30 of the conductor 3, and the outer peripheral surface of the sealing part 40 is in close contact with the inner wall surface of the third recess 24C. The sealing part 40 closes a gap between the conductor 3 and the housing 2, and restricts the flow of liquid between the internal space 102 of the first device 100 and the internal space 202 of the second device 200. That is, the sealing part 40 restricts the first liquid 104 of the first device 100 from leaking to a space on the support member 5 side of the sealing part 40.

In the connector 1 of the present embodiment, the conductors 3 are press-fitted into the first through holes 25 of the housing 2, and held by the first through holes 25. The conductors 3 are inserted into the first through holes 25, up to a position where the stoppers 34 (see FIG. 2) abut on the bottom wall part 51 of the support member 5. The stoppers 34 of the conductors 3 support the support member 5 while pressing the support member 5 toward the sealing member 4.

The protrusions 52 of the support member 5 are accommodated in the recesses 43 of the sealing member 4. The protrusions 52 come into contact with the bottom surface 43*a* of the recess 43. Furthermore, the bottom wall part 51 of the support member 5 comes into contact with the first surface 41*a* of the connecting part 41. In other words, the support member 5 interposes the sealing member 4 between the support member 5 and the housing 2 to support the sealing member 4 from the second device 200 side. The protrusions 52 of the support member 5 support the sealing parts 40 of the sealing member 4 from the second device 200 side. Accordingly, the support member 5 can support the sealing parts 40 against the pressure of the internal space 102 of the first device 100 and suppress deformation of the sealing parts 40. Furthermore, the sealing parts 40 are connected by the connecting part 41, so that the deformation of the sealing part 40 is suppressed.

Furthermore, the connector 1 of the present embodiment has a first insertion structure 7 and a second insertion structure 8 as will be described with reference to FIG. 23. The connector 1 ensures a space distance and a creepage distance between the adjacent conductors 3 by the first insertion structure 7 and the second insertion structure 8. As illustrated in FIG. 23, the first insertion structure 7 and the second insertion structure 8 are disposed between the adjacent conductors 3. The first insertion structure 7 is composed of the housing 2 and the sealing member 4. The first insertion structure 7 has a first concave part 45 and a first insertion wall 27.

The first concave part 45 is a concave part provided in the sealing member 4. The first concave part 45 has a pair of first facing surfaces 46 and a first connection surface 47. The first facing surface 46 is the outer peripheral surface of the sealing part 40. The pair of first facing surfaces 46 face each other in the first direction X. The first connection surface 47 is a part of the second surface 41*b* of the connecting part 41. The first connection surface 47 connects base ends of the pair of first facing surfaces 46 along the first direction X. The first concave part 45 opened toward the housing 2 side is formed by the pair of first facing surfaces 46 and the first connection surface 47.

The first insertion wall 27 is an insertion wall provided in the housing 2. The first insertion wall 27 is a wall part that divides between the adjacent third recesses 24C. The first insertion wall 27 protrudes toward the sealing member 4 along the height direction Z. The first insertion wall 27 extends along the second direction Y so as to partition the adjacent conductors 3. The first insertion wall 27 is inserted into the first concave part 45. The first insertion wall 27 is inserted, for example, up to a position where the tip end surface of the first insertion wall 27 comes into contact with the first connection surface 47 or a position where the tip end surface of the first insertion wall 27 approaches the first connection surface 47. The first insertion structure 7 is designed such that the creepage distance between the adjacent conductors 3 becomes a desired distance.

The second insertion structure 8 is composed of the sealing member 4 and the support member 5. The second insertion structure 8 has a second concave part 57 and a second insertion wall 48. The second concave part 57 is a concave part provided in the support member 5. The second concave part 57 has a pair of second facing surfaces 58 and a second connection surface 59. The second facing surface 58 is the outer peripheral surface of the protrusion 52. The pair of second facing surfaces 58 face each other in the first direction X. The second connection surface 59 is a part of the outer surface 51*b* of the bottom wall part 51. The second connection surface 59 connects base ends of the pair of second facing surfaces 58 along the first direction X. The second concave part 57 opened toward the sealing member 4 is formed by the pair of second facing surfaces 58 and the second connection surface 59.

The second insertion wall 48 is an insertion wall provided in the sealing member 4. The second insertion wall 48 is a wall part that divides between the adjacent recesses 43. The second insertion wall 48 protrudes toward the support member 5 along the height direction Z. The second insertion wall 48 extends along the second direction Y so as to partition the adjacent conductors 3. The second insertion wall 48 is inserted into the second concave part 57. The second insertion wall 48 is inserted, for example, up to a position where the tip end surface of the second insertion wall 48 comes into contact with the second connection surface 59 or a position where the tip end surface of the second insertion wall 48 approaches the second connection surface 59. The second insertion structure 8 is designed such that the creepage distance between the adjacent conductors 3 becomes a desired distance.

As described above, the connector 1 of the present embodiment has the insulating housing 2, the conductors 3, the insulating sealing member 4, and the insulating support member 5. The housing 2 is fixed to the casing 101 of the first device 100 at the communication part 10 through which the opening 101*b* of the casing 101 of the first device 100 and the opening 201*b* of the casing 201 of the second device 200 communicate with each other. The housing 2 has the first through holes 25 that allow the internal space 102 of the first device 100 and the internal space 202 of the second device 200 to communicate with each other.

The conductors 3 are inserted into the respective first through holes 25 to electrically connect the first device 100 and the second device 200. The sealing member 4 has the sealing parts 40 and the connecting part 41. The sealing parts 40 are tubular and seal between the conductors 3 and the housing 2. The connecting part 41 connects the sealing parts 40 to each other.

The support member 5 has the second through holes 54 into which the conductors 3 are inserted. The support member 5 is attached to the housing 2 from the second device 200 side. The support member 5 interposes the sealing member 4 between the support member 5 and the housing 2 to support the sealing parts 40.

The connector 1 of the present embodiment can improve the efficiency of assembly work of the connector 1. For example, by assembling the conductor unit 6 to the housing 2, the conductors 3 can be attached to the housing 2 at one time, so that assembling steps are simplified. As a connector of a comparative example, it is assumed that one O-ring is attached to each of the conductors 3 and the O-ring is supported by an independent stopper. In the connector of the comparative example, it is necessary to attach the stopper and the O-ring to each of the conductors 3 and to sequentially attach the conductors 3 to the housing 2. According to the connector 1 of the present embodiment, it is possible to reduce the number of assembling steps and improve work efficiency with respect to the connector of the comparative example.

The support member 5 of the present embodiment has the insulating walls 53 that partition the conductors 3 adjacent to each other. The support member 5 is provided with the insulating walls 53, so that it is possible to reduce the number of parts.

The connector 1 of the present embodiment has the first insertion structure 7 disposed between the conductors 3 adjacent to each other. The first insertion structure 7 has the first concave part 45 and the first insertion wall 27. The first concave part 45 is included in one of the housing 2 and the sealing member 4, and is provided in the sealing member 4 in the present embodiment. The first insertion wall 27 is included in the other one of the housing 2 and the sealing member 4, and is provided in the housing 2 in the present embodiment.

The first concave part 45 has the pair of first facing surfaces 46 and 46 facing each other in the arrangement direction in which the conductors 3 are arranged and the first connection surface 47 connecting the pair of first facing surfaces 46 and 46. The first insertion wall 27 is inserted between the pair of first facing surfaces 46 and 46. According to the connector 1 of the present embodiment, it is possible to ensure the creepage distance and the space distance between the adjacent conductors 3 by the first insertion structure 7.

The connector 1 of the present embodiment has the second insertion structure 8 disposed between the conductors 3 adjacent to each other. The second insertion structure 8 has the second concave part 57 and the second insertion wall 48. The second concave part 57 is included in one of the sealing member 4 and the support member 5, and is provided in the support member 5 in the present embodiment. The second insertion wall 48 is included in the other one of the sealing member 4 and the support member 5, and is provided in the sealing member 4 in the present embodiment.

The second concave part 57 has the pair of second facing surfaces 58 and 58 facing each other in the arrangement direction in which the conductors 3 are arranged and the second connection surface 59 connecting the pair of second facing surfaces 58 and 58. The second insertion wall 48 is inserted between the pair of pair of second facing surfaces 58 and 58. According to the connector 1 of the present embodiment, it is possible to ensure the creepage distance and the space distance between the adjacent conductors 3 by the second insertion structure 8.

The material of the housing 2 and the material of the sealing member 4 of the present embodiment have resistance to the first liquid 104. The material of the support member 5 has resistance to the second liquid 205 different from the first liquid 104. Since the housing 2, the sealing member 4, and the support member 5 have resistance according to their respective environments, appropriate sealing performance is exhibited. In the present embodiment, oil resistance is given to the housing 2 and the sealing member 4, and water resistance is given to the support member 5. In the present embodiment, it is possible to reduce the manufacturing cost of parts by manufacturing portions that do not need to have oil resistance with an inexpensive material.

MODIFIED EXAMPLES OF EMBODIMENT

The number and shape of the conductors 3 are not limited to the number and shape illustrated in the embodiment. For example, the shape of the conductor 3 may be a shape such as a pin having a circular section. The shapes of the housing 2, the sealing member 4, and the support member 5 are appropriately designed according to the shape of the conductor 3. When a pin having a circular section is used as the conductor 3, the sectional shapes of the first through hole 25 and the second through hole 54 are circular. Furthermore, the sectional shape of the sealing part 40 of the sealing member 4 is circular. The use of the conductor 3 is not limited to a power supply line that supplies electric power, and may be a signal line.

The shape of the sealing part 40 is not limited to the illustrated shape. Furthermore, the sealing part 40 is not limited to the shaft seal and may be a face seal.

The insulating wall 53 may be provided in a member different from the support member 5. In other words, a member different from the support member 5 may partition the adjacent conductors 3.

In the first insertion structure 7, the housing 2 may be provided with the first concave part and the sealing member 4 may be provided with the first insertion wall. In the second insertion structure 8, the sealing member 4 may be provided with the second concave part and the support member 5 may be provided with the second insertion wall.

The first device 100 is not limited to the motor and the second device 200 is not limited to the inverter. Furthermore, the first liquid 104 is not limited to the oil and the second liquid 205 is not limited to the cooling water.

The contents disclosed in the aforementioned embodiment and modified examples can be combined and implemented as appropriate.

The connector according to the embodiment has the sealing member provided with the sealing parts, the support member that interposes the sealing member between the support member and the housing to support the sealing parts. In accordance with the connector according to the embodiment, the conductors are collectively assembled in the housing, thereby obtaining an effect that it is possible to simplify manufacturing work.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

an insulating housing that is fixed to a casing of a first device at a communication part through which an opening of the casing of the first device and an opening of a casing of a second device communicate with each other, and includes a plurality of first through holes that allow an internal space of the first device and an internal space of the second device to communicate with each other;

a plurality of conductors configured to be inserted into the respective first through holes to electrically connect the first device and the second device;

an insulating sealing member that includes a plurality of annular sealing parts that seal between the conductors and the housing, and a connecting part that connects the sealing parts; and an insulating support member that includes a plurality of second through holes into which the conductors are inserted, is configured to be attached to the housing from a side of the second device so as to interpose the sealing member between the support member and the housing and support the sealing parts.

2. The connector according to claim 1, wherein a material of the housing and a material of the sealing member have resistance to a first liquid stored in the internal space of the first device, and a material of the support member has resistance to a second liquid different from the first liquid.

3. The connector according to claim 1, further comprising:

a second insertion structure disposed between the conductors adjacent to each other, wherein the second insertion structure includes a second concave part provided in one of the sealing member and the support member, and a second insertion wall provided in the other one of the sealing member and the support member, the second concave part includes a pair of second facing surfaces facing each other in an arrangement direction in which the conductors are arranged and a second connection surface connecting the pair of second facing surfaces, and the second insertion wall is inserted between the pair of second facing surfaces.

4. The connector according to claim 3, wherein a material of the housing and a material of the sealing member have resistance to a first liquid stored in the internal space of the first device, and a material of the support member has resistance to a second liquid different from the first liquid.

5. The connector according to claim 1, further comprising:

a first insertion structure disposed between the conductors adjacent to each other, wherein the first insertion structure includes a first concave part provided in one of the housing and the sealing member, and a first insertion wall provided in the other one of the housing and the sealing member, the first concave part includes a pair of first facing surfaces facing each other in an arrangement direction in which the conductors are arranged and a first connection surface connecting the pair of first facing surfaces, and the first insertion wall is inserted between the pair of first facing surfaces.

6. The connector according to claim 5, further comprising:

a second insertion structure disposed between the conductors adjacent to each other, wherein the second insertion structure includes a second concave part provided in one of the sealing member and the support member, and a second insertion wall provided in the other one of the sealing member and the support member, the second concave part includes a pair of second facing surfaces facing each other in an arrangement direction in which the conductors are arranged and a second connection surface connecting the pair of second facing surfaces, and the second insertion wall is inserted between the pair of second facing surfaces.

7. The connector according to claim 5, wherein a material of the housing and a material of the sealing member have resistance to a first liquid stored in the internal space of the first device, and a material of the support member has resistance to a second liquid different from the first liquid.

8. The connector according to claim 1, wherein the support member includes an insulating wall that partitions the conductors adjacent to each other.

9. The connector according to claim 8, further comprising:

a first insertion structure disposed between the conductors adjacent to each other, wherein the first insertion structure includes a first concave part provided in one of the housing and the sealing member, and a first insertion wall provided in the other one of the housing and the sealing member, the first concave part includes a pair of first facing surfaces facing each other in an arrangement direction in which the conductors are arranged and a first connection surface connecting the pair of first facing surfaces, and the first insertion wall is inserted between the pair of first facing surfaces.

10. The connector according to claim 8, further comprising:

a second insertion structure disposed between the conductors adjacent to each other, wherein the second insertion structure includes a second concave part provided in one of the sealing member and the support member, and a second insertion wall provided in the other one of the sealing member and the support member, the second concave part includes a pair of second facing surfaces facing each other in an arrangement direction in which the conductors are arranged and a second connection surface connecting the pair of second facing surfaces, and the second insertion wall is inserted between the pair of second facing surfaces.

11. The connector according to claim 8, wherein a material of the housing and a material of the sealing member have resistance to a first liquid stored in the internal space of the first device, and a material of the support member has resistance to a second liquid different from the first liquid.

* * * * *